US012196462B2

(12) United States Patent
Welch et al.

(10) Patent No.: US 12,196,462 B2
(45) Date of Patent: Jan. 14, 2025

(54) HEAT-PUMP SYSTEM WITH MULTIWAY VALVE

(71) Applicant: Copeland LP, Sidney, OH (US)

(72) Inventors: Andrew M. Welch, Franklin, OH (US); Winfield S. Morter, Dayton, OH (US)

(73) Assignee: Copeland LP, Sidney, OH (US)

( * ) Notice: Subject to any disclaimer, the term of this patent is extended or adjusted under 35 U.S.C. 154(b) by 36 days.

(21) Appl. No.: 17/210,095

(22) Filed: Mar. 23, 2021

(65) Prior Publication Data

US 2022/0307736 A1 Sep. 29, 2022

(51) Int. Cl.

| | |
|---|---|
| ***F25B 30/02*** | (2006.01) |
| ***F25B 13/00*** | (2006.01) |
| ***F25B 41/31*** | (2021.01) |

(52) U.S. Cl.

CPC ..... *F25B 30/02* (2013.01); *F25B 13/00* (2013.01); *F25B 41/31* (2021.01); *F25B 2313/02741* (2013.01); *F25B 2313/0276* (2013.01)

(58) Field of Classification Search

CPC ..... F25B 30/02; F25B 13/00; F25B 41/31; F25B 2313/02741; F25B 2313/0276

See application file for complete search history.

(56) References Cited

U.S. PATENT DOCUMENTS

| | | | |
|---|---|---|---|
| 4,191,023 | A | 3/1980 | Sisk et al. |
| 4,384,608 | A | 5/1983 | Scarlett et al. |
| 4,441,901 | A | 4/1984 | Endoh |
| 4,716,957 | A | 1/1988 | Thompson et al. |
| 4,761,964 | A | 8/1988 | Pacheco |
| 4,805,689 | A | 2/1989 | Inada et al. |

(Continued)

FOREIGN PATENT DOCUMENTS

| | | | | |
|---|---|---|---|---|
| CN | 101144662 | A | 3/2008 | |
| CN | 110529628 | A * | 12/2019 | ..... B60H 1/00392 |

(Continued)

OTHER PUBLICATIONS

Chen (CN110529628A), Multi-way valve, thermal management system and electric automobile, English Translation, Dec. 3, 2019, Whole Document (Year: 2019).*

(Continued)

*Primary Examiner* — Larry L Furdge
*Assistant Examiner* — Keith Stanley Myers
(74) *Attorney, Agent, or Firm* — Harness, Dickey & Pierce, P.L.C.

(57) ABSTRACT

A heat-pump system is provided that includes an outdoor heat exchanger, an expansion device, an indoor heat exchanger, a compressor, and a multiway valve. The expansion device is in fluid communication with the outdoor heat exchanger. The indoor heat exchanger is in fluid communication with the expansion device. The compressor circulates working fluid through the indoor and outdoor heat exchangers. The multiway valve is movable between a first position corresponding to a cooling mode of the heat-pump system and a second position corresponding to a heating mode of the heat-pump system. The working fluid flows in the same direction through the outdoor heat exchanger in the cooling mode and in the heating mode, and the working fluid flows in the same direction through the indoor heat exchanger in the cooling mode and in the heating mode.

16 Claims, 26 Drawing Sheets

(56) References Cited

U.S. PATENT DOCUMENTS

| | | | | |
|---|---|---|---|---|
| 4,921,163 | A | 5/1990 | Viessmann | |
| 5,249,436 | A | 10/1993 | Hemsath | |
| 5,357,781 | A | 10/1994 | Tikijian | |
| 5,473,907 | A | 12/1995 | Briggs | |
| 5,509,274 | A | 4/1996 | Lackstrom | |
| 5,515,689 | A | 5/1996 | Atterbury | |
| 5,820,262 | A | 10/1998 | Lechner | |
| 5,970,721 | A | 10/1999 | Kamimura et al. | |
| 6,644,047 | B2 | 11/2003 | Taira et al. | |
| 6,655,161 | B1 | 12/2003 | Koo | |
| 6,701,722 | B1 | 3/2004 | Seo et al. | |
| 6,772,598 | B1 | 8/2004 | Rinehart | |
| 6,791,088 | B1 | 9/2004 | Williams, II et al. | |
| 6,868,678 | B2 | 3/2005 | Mei et al. | |
| 6,973,794 | B2 | 12/2005 | Street et al. | |
| 7,197,914 | B2 | 4/2007 | Maresca, Jr. et al. | |
| 7,814,757 | B2 | 10/2010 | Zima et al. | |
| 7,849,700 | B2 | 12/2010 | Seefeldt | |
| 8,215,121 | B2 | 7/2012 | Yoshimi et al. | |
| 8,280,557 | B2 | 10/2012 | Kawano et al. | |
| 8,899,056 | B2 | 12/2014 | Kawano et al. | |
| 8,899,099 | B2 | 12/2014 | Grosse Bley et al. | |
| 8,924,026 | B2 | 12/2014 | Federspiel et al. | |
| 9,222,711 | B2 | 12/2015 | Ochiai et al. | |
| 9,239,183 | B2 | 1/2016 | Amick | |
| 9,353,979 | B2 | 5/2016 | Morimoto et al. | |
| 9,459,032 | B2 | 10/2016 | Nishimura et al. | |
| 9,625,195 | B2 | 4/2017 | Hiraki et al. | |
| 9,739,513 | B2 | 8/2017 | Ochiai et al. | |
| 9,915,450 | B2 | 3/2018 | Seggerman | |
| 9,933,205 | B2 | 4/2018 | Hatomura et al. | |
| 9,970,665 | B2 | 5/2018 | Bush et al. | |
| 10,047,990 | B2 | 8/2018 | Marshall et al. | |
| 10,113,763 | B2 | 10/2018 | Ochiai et al. | |
| 10,354,332 | B2 | 7/2019 | Trainor et al. | |
| 10,514,176 | B2 | 12/2019 | Weinert | |
| 10,533,764 | B2 | 1/2020 | Yamada et al. | |
| 10,569,620 | B2 | 2/2020 | Vehr et al. | |
| 10,571,171 | B2 | 2/2020 | Gariety et al. | |
| 10,712,061 | B2 | 7/2020 | Tashiro et al. | |
| 10,941,965 | B2 | 3/2021 | Diemer Lopes | |
| 11,725,857 | B1 | 8/2023 | O'Brien et al. | |
| 2005/0263394 | A1 | 12/2005 | Lewis et al. | |
| 2006/0162351 | A1 | 7/2006 | Yahia | |
| 2012/0318011 | A1 | 12/2012 | Ochiai et al. | |
| 2016/0109144 | A1 | 4/2016 | Kim et al. | |
| 2016/0153687 | A1 | 6/2016 | Deng | |
| 2016/0167481 | A1* | 6/2016 | Makihara | B60H 1/00485 237/5 |
| 2016/0178229 | A1 | 6/2016 | Chen et al. | |
| 2017/0284561 | A1* | 10/2017 | Zahlhaas | F16K 31/002 |
| 2018/0094844 | A1 | 4/2018 | Suzuki | |
| 2018/0347896 | A1 | 12/2018 | Eddy et al. | |
| 2018/0372354 | A1 | 12/2018 | Brizendine et al. | |
| 2019/0056133 | A1* | 2/2019 | Green | F24F 11/36 |
| 2019/0128569 | A1 | 5/2019 | Tada et al. | |
| 2019/0170599 | A1 | 6/2019 | Kester | |
| 2019/0170603 | A1 | 6/2019 | Gupte et al. | |
| 2019/0170604 | A1 | 6/2019 | Kester | |
| 2019/0226705 | A1 | 7/2019 | Sakae et al. | |
| 2019/0242632 | A1 | 8/2019 | Sakae et al. | |
| 2019/0277549 | A1* | 9/2019 | Nishiyama | F25B 41/20 |
| 2019/0301780 | A1 | 10/2019 | Schmidt et al. | |
| 2019/0331377 | A1 | 10/2019 | Matsuda et al. | |
| 2019/0368752 | A1 | 12/2019 | Shiohama et al. | |
| 2019/0383526 | A1 | 12/2019 | Nishiyama et al. | |
| 2019/0390876 | A1 | 12/2019 | Matsuda et al. | |
| 2020/0011580 | A1 | 1/2020 | Matsuda et al. | |
| 2020/0033036 | A1 | 1/2020 | Yamada et al. | |
| 2020/0049361 | A1 | 2/2020 | Minamida et al. | |
| 2020/0124306 | A1 | 4/2020 | Kowald et al. | |
| 2020/0166257 | A1 | 5/2020 | Wada et al. | |
| 2020/0271364 | A1* | 8/2020 | Creason | F25B 49/005 |
| 2020/0326113 | A1 | 10/2020 | Donovan et al. | |

FOREIGN PATENT DOCUMENTS

| | | | | |
|---|---|---|---|---|
| EP | 1970651 | A1 | 9/2008 | |
| EP | 3051236 | A1 | 8/2016 | |
| EP | 3287720 | A1 | 2/2018 | |
| EP | 3358278 | A1 | 8/2018 | |
| EP | 3418655 | A1 | 12/2018 | |
| EP | 1970651 | B1 | 7/2019 | |
| EP | 3569944 | A1 | 11/2019 | |
| EP | 3604981 | A1 | 2/2020 | |
| EP | 3614070 | A1 | 2/2020 | |
| JP | H09105536 | A | 4/1997 | |
| JP | 11030446 | A * | 2/1999 | |
| JP | H11030446 | A | 2/1999 | |
| JP | 2005346269 | A | 12/2005 | |
| JP | 2006220416 | A | 8/2006 | |
| JP | 2019027526 | A * | 2/2019 | B60H 1/00485 |
| KR | 0158993 | B1 | 1/1999 | |
| KR | 20080090105 | A | 10/2008 | |
| KR | 20200001931 | A | 1/2020 | |
| WO | WO-2017058997 | A1 | 4/2017 | |
| WO | WO-2019150462 | A1 | 8/2019 | |
| WO | WO-2019171588 | A1 | 9/2019 | |

OTHER PUBLICATIONS

Tetsuya (JP2019027526A), Integrated Valve Gear, English Translation, Feb. 21, 2019, Whole Document (Year: 2019).*

Kasai et al. (JP H1130446 A), English Translation, Refrigerating Cycle, Feb. 2, 1999, Whole Document (Year: 1999).*

U.S. Appl. No. 16/940,808, filed Jul. 28, 2020, Brian R. Butler.

U.S. Appl. No. 17/019,946, filed Sep. 14, 2020, Andrew M. Welch.

U.S. Appl. No. 17/210,095, filed Mar. 23, 2021, Andrew M. Welch.

The Engineering Mindset; "Reversing valve—Heat Pump. How it works, Operation."; Jun. 25, 2017 <https://www.google.com/url?sa=i&url=https%3A%2F%2Fwww.youtube.com%2Fwatch%3Fv%3Dr8n1_6qmsKQ&psig=AOvVaw3KwtomkGwDJVhbQDjFw8OV&ust=1598627750015000&source=images&cd=vfe&ved=0CAIQjRxqFwoTCNDDvs7Wu-sCFQAAAAAdAAAAABAL>.

Examiner-Initiated Interview Summary regarding U.S. Appl. No. 16/940,843 dated Feb. 5, 2021.

Feng, Shaobin, et al. "Review on Smart Gas Sensing Technology," MDPI Journal on Sensors 2019; Basel Switzerland, Published Aug. 30, 2019.

Danfoss Application Guide: "Gas Detection in Refrigeration Systems", 2018.

Nevanda Nano: "Leak Detection Technologies for A2L Refrigerants in HVACR Equipment: Summary of AHRTI Final Report Findings" SM-AN-0012-02.

Islam, Tarikul and Mukjopadhyay, S.C.; "Linearization of the Sensors Characteristics: a review", Exeley International Journal on Smart Sensing and Intelligent Systems Article DOI 10.21307/ijssis-2019-007; Isue 1 Volune 12; 2019.

Final Office Action regarding U.S. Appl. No. 16/940,843 dated Mar. 18, 2021.

Applicant-Initiated Interview Summary regarding U.S. Appl. No. 16/940,843 dated May 4, 2021.

International Search Report regarding Application No. PCT/US2021/036209 dated Sep. 24, 2021.

Written Opinion of the ISA regarding Application No. PCT/US2021/036209 dated Sep. 24, 2021.

Daikin Altherma Hybrid Heat Pumps, "Deciding Between A Furnace, Heat Pump Or Hybrid: Know What Matters"; Sep. 29, 2021; https://www.daikin.eu/en_us/product-group/hybrid-heat-pump.html.

International Search Report regarding Application No. PCT/US2022/021382 dated Jun. 28, 2022.

Written Opinion of ISA regarding Application No. PCT/US2022/021382 dated Jun. 28, 2022.

Final Office Action regarding U.S. Appl. No. 16/940,808 dated May 26, 2022.

U.S. Appl. No. 17/210,160, filed Mar. 23, 2021, Brian R. Butler.

International Search Report regarding Application No. PCT/US2021/049260 dated Dec. 17, 2021.

(56) References Cited

OTHER PUBLICATIONS

Written Opinion of the ISA regarding Application No. PCT/US2021/049260 dated Dec. 17, 2021.
Applicant-Initiated Interview Summary regarding U.S. Appl. No. 16/940,808 dated Jan. 18, 2022.
Final Office Action regarding U.S. Appl. No. 16/940,808 dated May 26, 2021.
Final Office Action regrding U.S. Appl. No. 16/940,808 dated May 26, 2022.
Applicant-Initiated Interview Summary regarding U.S. Appl. No. 17/019,946 dated Dec. 19, 2022.
Office Action mailed Sep. 9, 2022, in corresponding U.S. Appl. No. 16/940,808.
Non-Final Office Action regarding U.S. Appl. No. 17/210,160 dated Apr. 17, 2023.

* cited by examiner

HEAT-PUMP SYSTEM WITH MULTIWAY VALVE

FIELD

The present disclosure relates to a reversible heat-pump system including one or more multiway valves.

BACKGROUND

This section provides background information related to the present disclosure and is not necessarily prior art.

A heat-pump system may include a fluid circuit having an outdoor heat exchanger, an indoor heat exchanger, an expansion device disposed between the indoor and outdoor heat exchangers, and a compressor circulating a working fluid (e.g., a refrigerant) between the indoor and outdoor heat exchangers. A reversing valve may be provided to switch the system between a heating mode and a cooling mode. The present disclosure provides heat-pump systems with one or more multiway valves that improve the efficiency of the systems.

SUMMARY

This section provides a general summary of the disclosure, and is not a comprehensive disclosure of its full scope or all of its features.

The present disclosure provides a heat-pump system that may include an outdoor heat exchanger, an expansion device, an indoor heat exchanger, a compressor, and a multiway valve. The expansion device is in fluid communication with the outdoor heat exchanger. The indoor heat exchanger is in fluid communication with the expansion device. The compressor circulates working fluid through the indoor and outdoor heat exchangers. The multiway valve may be movable between a first position corresponding to a cooling mode of the heat-pump system and a second position corresponding to a heating mode of the heat-pump system. The working fluid flows in the same direction through the outdoor heat exchanger in the cooling mode and in the heating mode, and the working fluid flows in the same direction through the indoor heat exchanger in the cooling mode and in the heating mode.

In some configurations, the multiway valve includes a first inlet, a second inlet, a first outlet, and a second outlet.

In some configurations, the first inlet receives working fluid from the compressor in the heating mode and in the cooling mode.

In some configurations, the second inlet receives working fluid from the expansion device in the heating mode and in the cooling mode.

In some configurations, the outdoor heat exchanger receives working fluid from the first outlet in the heating mode and in the cooling mode.

In some configurations, the indoor heat exchanger receives working fluid from the second outlet in the heating mode and in the cooling mode.

In some configurations, the heat-pump system includes a second multiway valve having a first inlet, a second inlet, a first outlet, and a second outlet.

In some configurations, the first inlet of the second multiway valve receives working fluid from the outdoor heat exchanger in the heating mode and in the cooling mode; the second inlet of the second multiway valve receives working fluid from the indoor heat exchanger in the heating mode and in the cooling mode; the expansion device receives working fluid from the first outlet of the second multiway valve in the heating mode and in the cooling mode; and the compressor receives working fluid from the second outlet of the second multiway valve in the heating mode and in the cooling mode.

In some configurations, the heat-pump system can be switched among the cooling mode, the heating mode, and an isolation mode; when the heat-pump system is in the isolation mode, the multiway valves separate the heat-pump system into an indoor loop and an outdoor loop that are fluidly isolated from each other; the indoor loop includes the indoor heat exchanger; and the outdoor loop includes the outdoor heat exchanger and the compressor.

In some configurations, the heat-pump system can be switched among the cooling mode, the heating mode, and an isolation mode; and when the heat-pump system is in the isolation mode, the indoor heat exchanger is fluidly isolated from the compressor and the outdoor heat exchanger.

In some configurations, the multiway valve includes a third inlet and a third outlet.

In some configurations, the first inlet of the multiway valve receives working fluid from the compressor in the heating mode and in the cooling mode; the second inlet of the multiway valve receives working fluid from the indoor heat exchanger in the heating mode and in the cooling mode; the third inlet of the multiway valve receives working fluid from the outdoor heat exchanger in the heating mode and in the cooling mode; the outdoor heat exchanger receives working fluid from the first outlet of the multiway valve in the heating mode and in the cooling mode; the indoor heat exchanger receives working fluid from the second outlet of the multiway valve in the heating mode and in the cooling mode; and the compressor receives working fluid from the third outlet of the multiway valve in the heating mode and in the cooling mode.

In some configurations, the first, second, and third inlets and the first, second, and third outlets are formed in a valve body of the multiway valve. The multiway valve includes a valve member disposed within the valve body. The valve member is movable relative to the valve body between the first position and the second position.

In some configurations, the valve member at least partially defines a first passageway, a second passageway, a third passageway, and a fourth passageway.

In some configurations, in the cooling mode: the first passageway fluidly connects the first inlet and the first outlet and extends from the first inlet to the first outlet; the second passageway allows fluid flow from the expansion device to the second outlet; the third passageway allows fluid flow from the third inlet to the expansion device; and the fourth passageway fluidly connects the second inlet and the third outlet and extends from the second inlet to the third outlet.

In some configurations, the valve member is rotatable relative to the valve body between the first and second positions.

In some configurations, the multiway valve includes a fourth inlet and a fourth outlet. The fourth inlet is fluidly connected to an outlet of the expansion device. The fourth outlet is fluidly connected to an inlet of the expansion device.

In some configurations, the valve member includes a fifth and sixth passageway.

In some configurations, the fifth and sixth passageways of the valve member are fluidly isolated from the first, second, third, and fourth inlets and the first, second, third, and fourth outlets in the cooling mode. The first and second passageways of the valve member are fluidly isolated from the first, second, third, and fourth inlets and the first, second, third, and fourth outlets in the heating mode.

In some configurations, the valve member is slidable in an axial direction relative to the valve body between the first and second positions.

In some configurations, the expansion device is disposed within a valve body of the multiway valve.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 24:
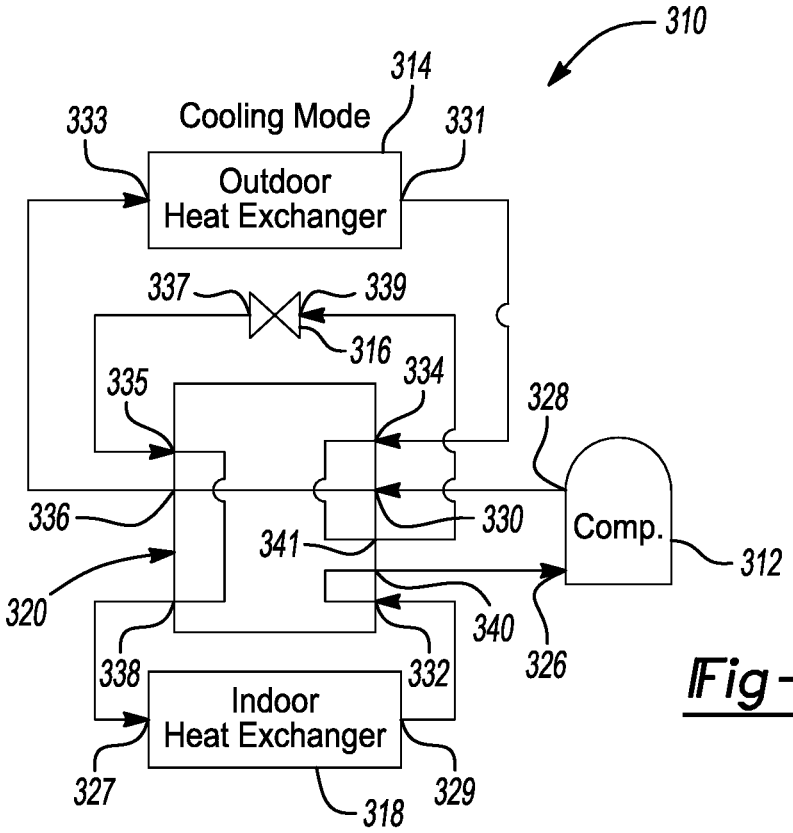
FIG. 24 is a schematic representation of yet another heat-pump system operating in a cooling mode.
Figure 25:
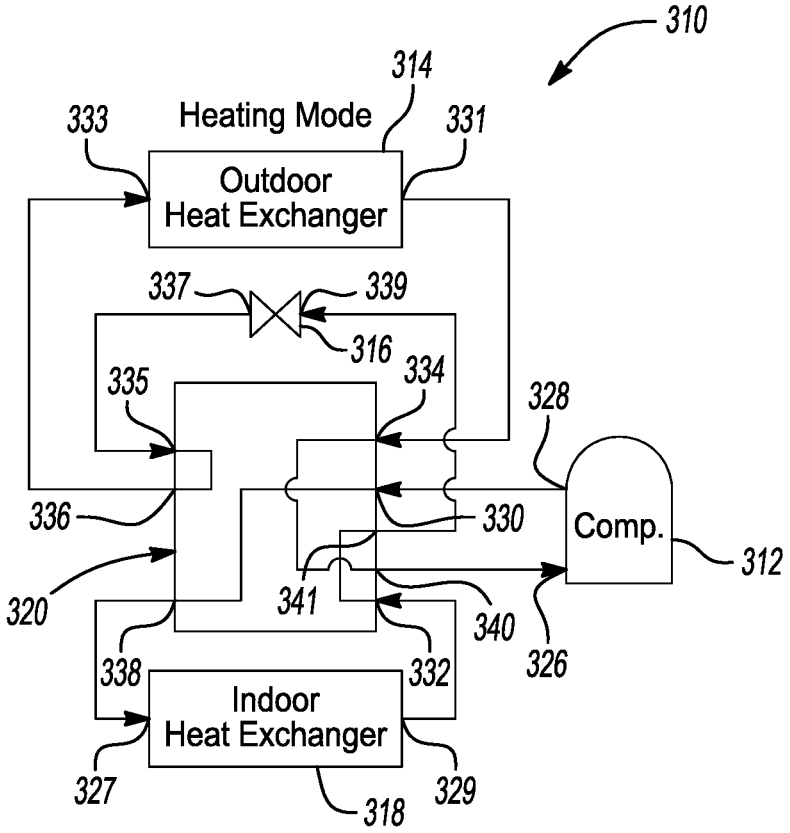
Figure 26:
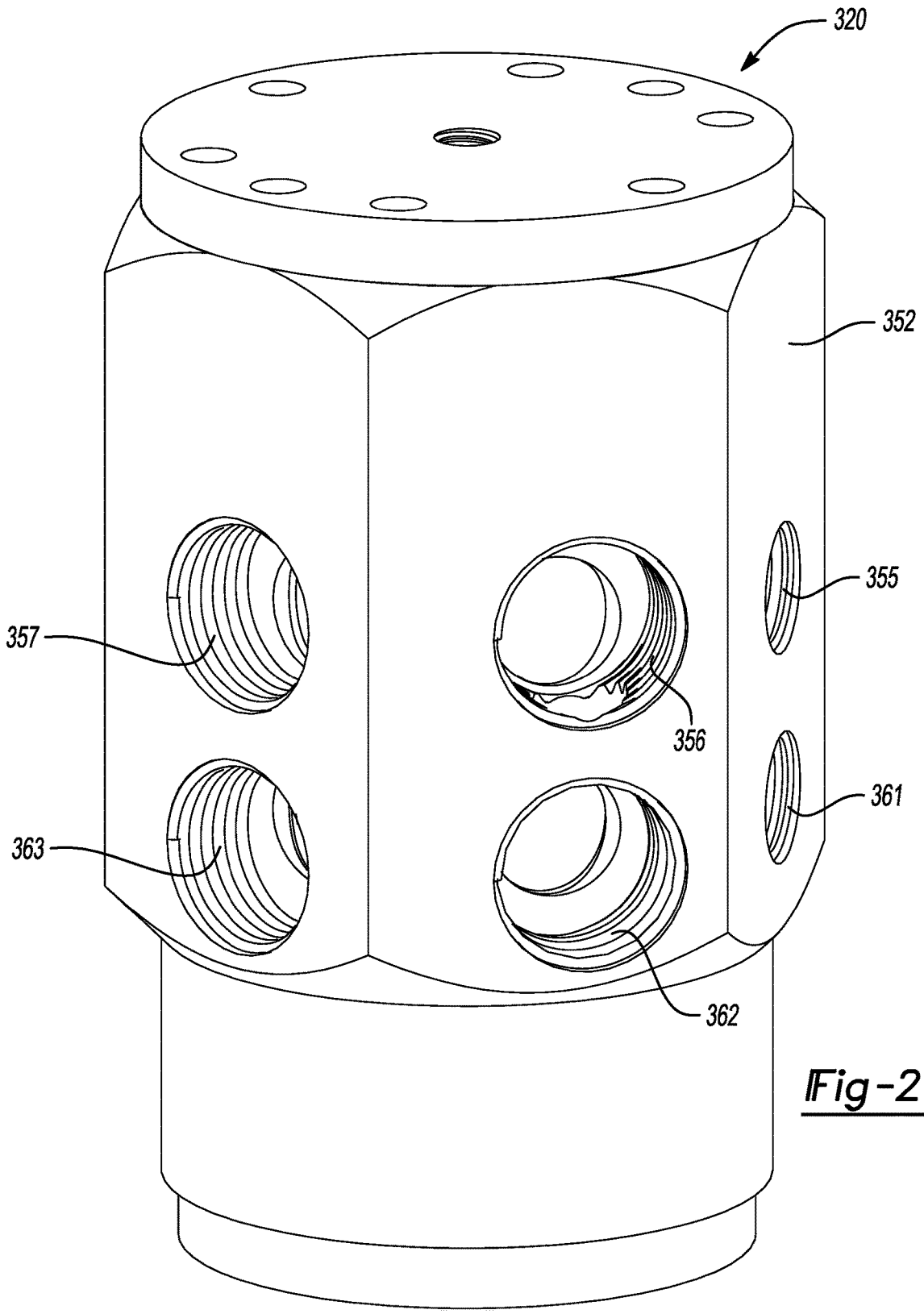
Figure 27:
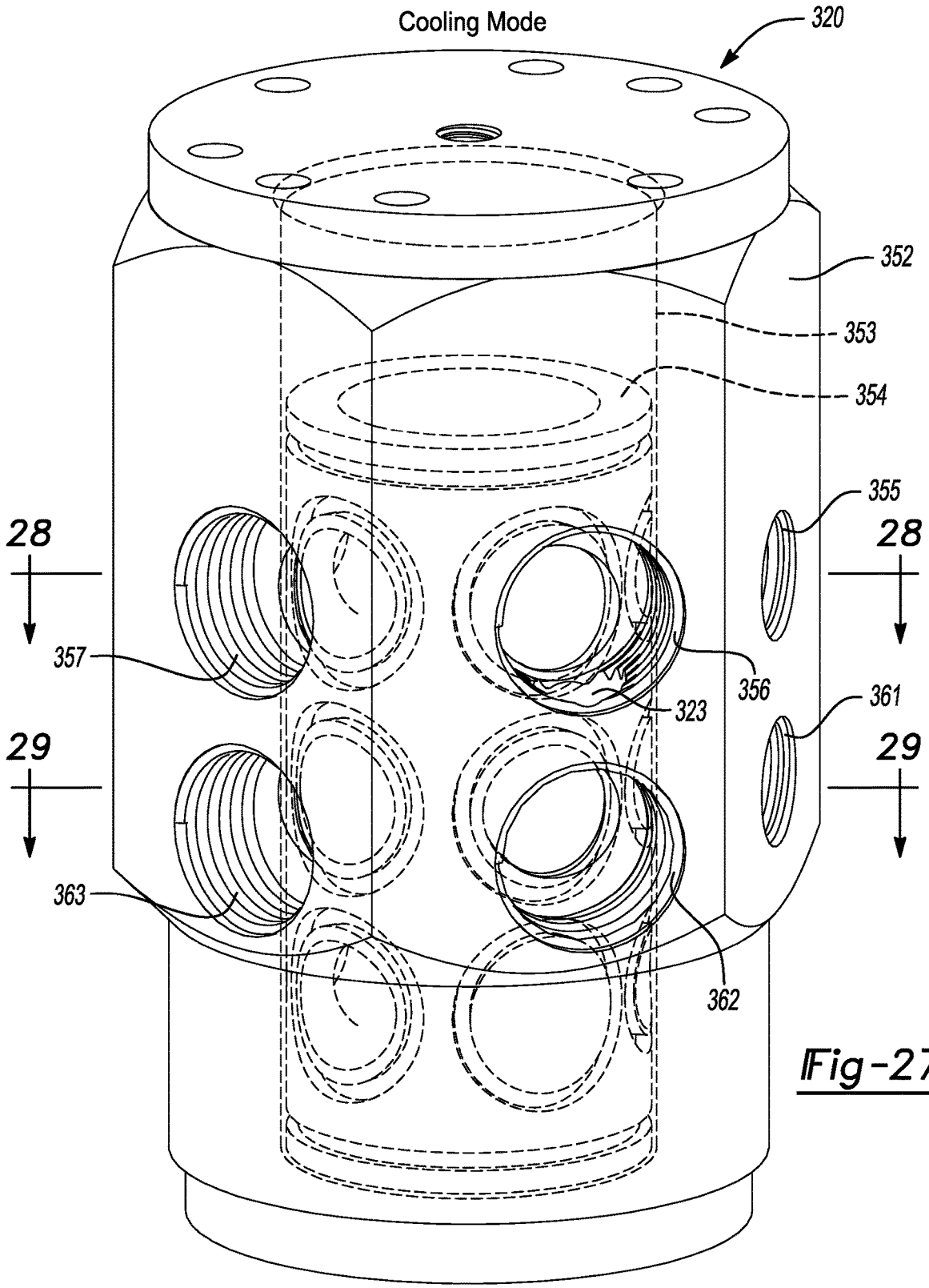
Figure 28:
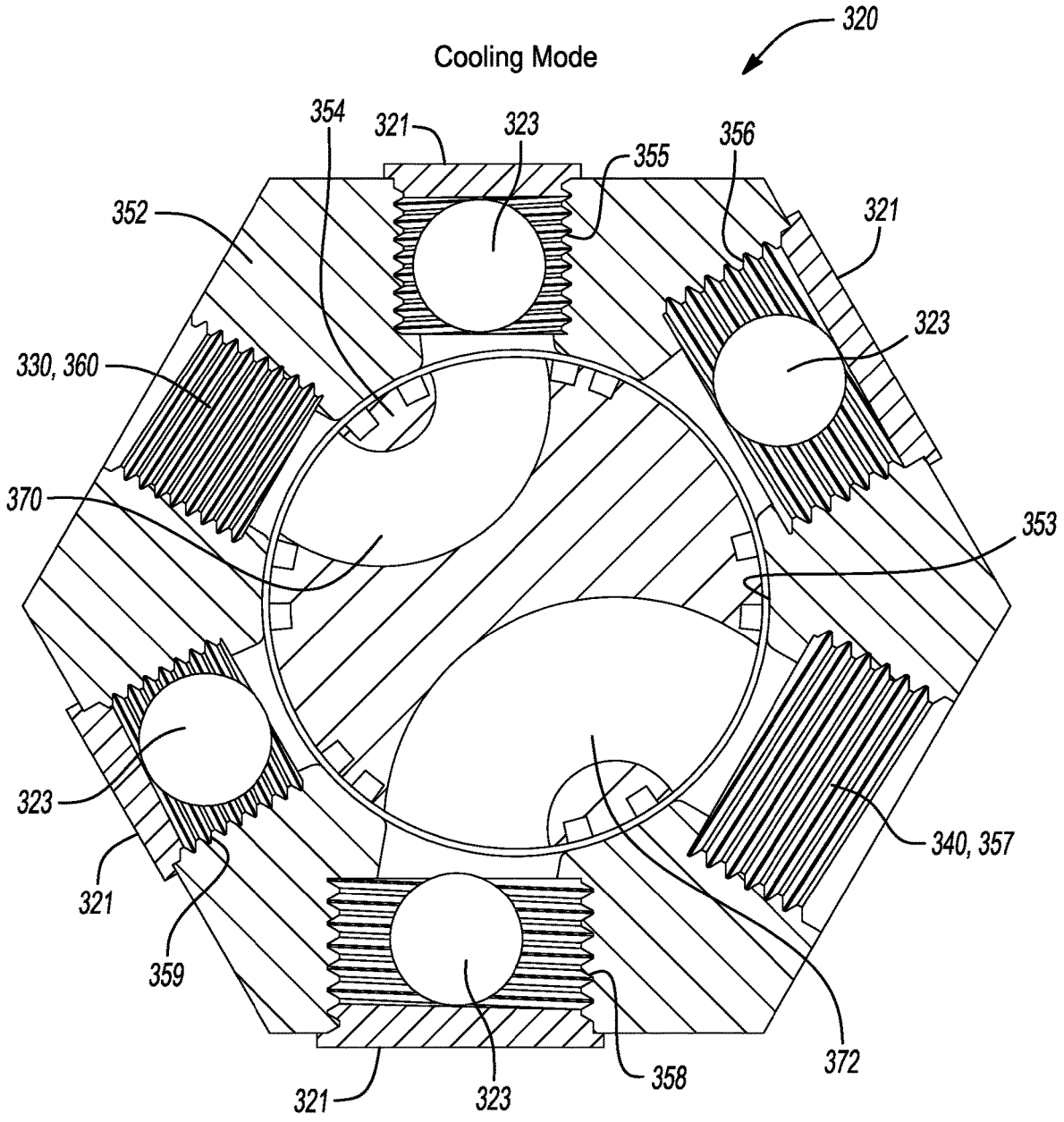
Figure 29:
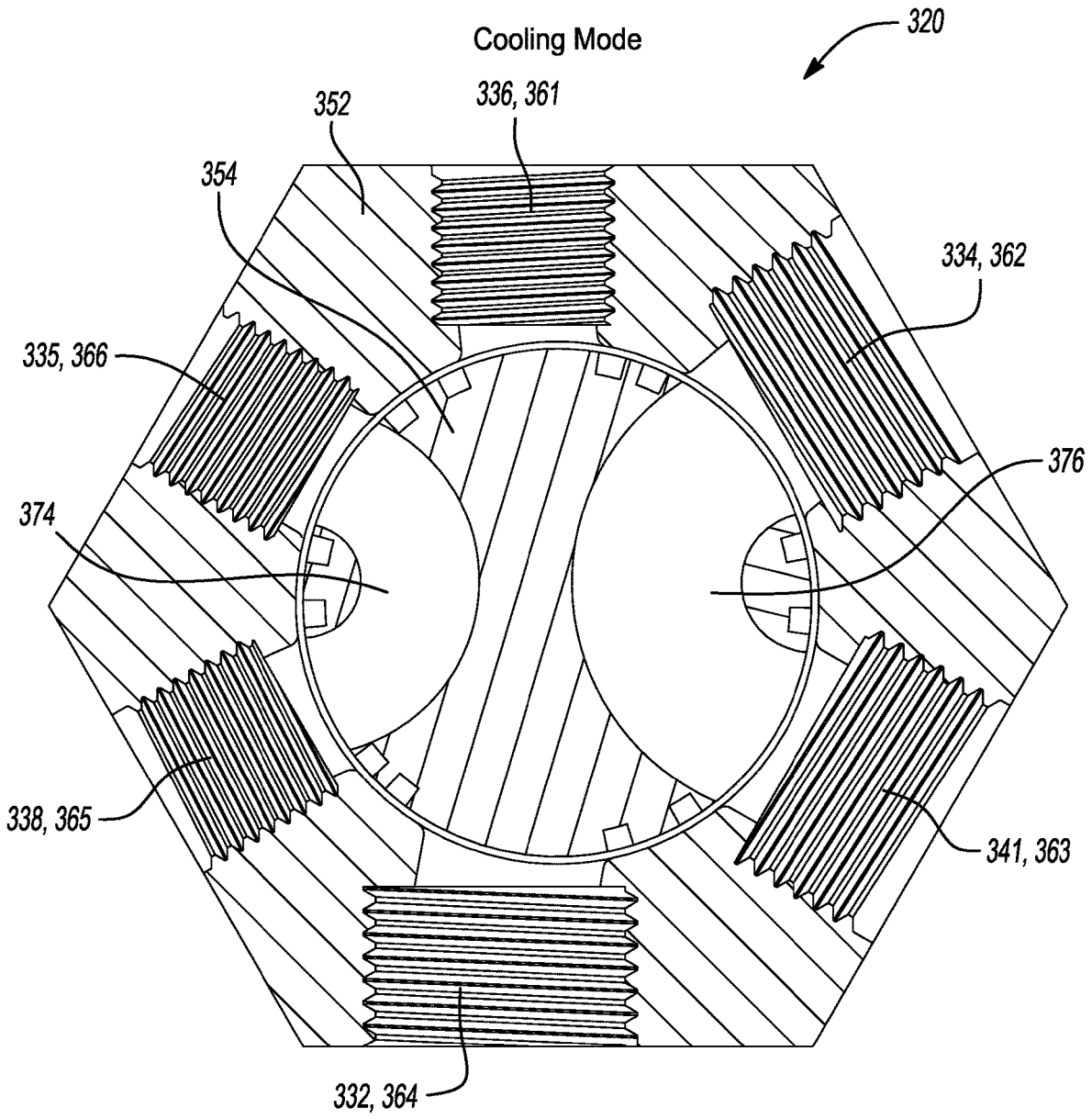
Figure 30:
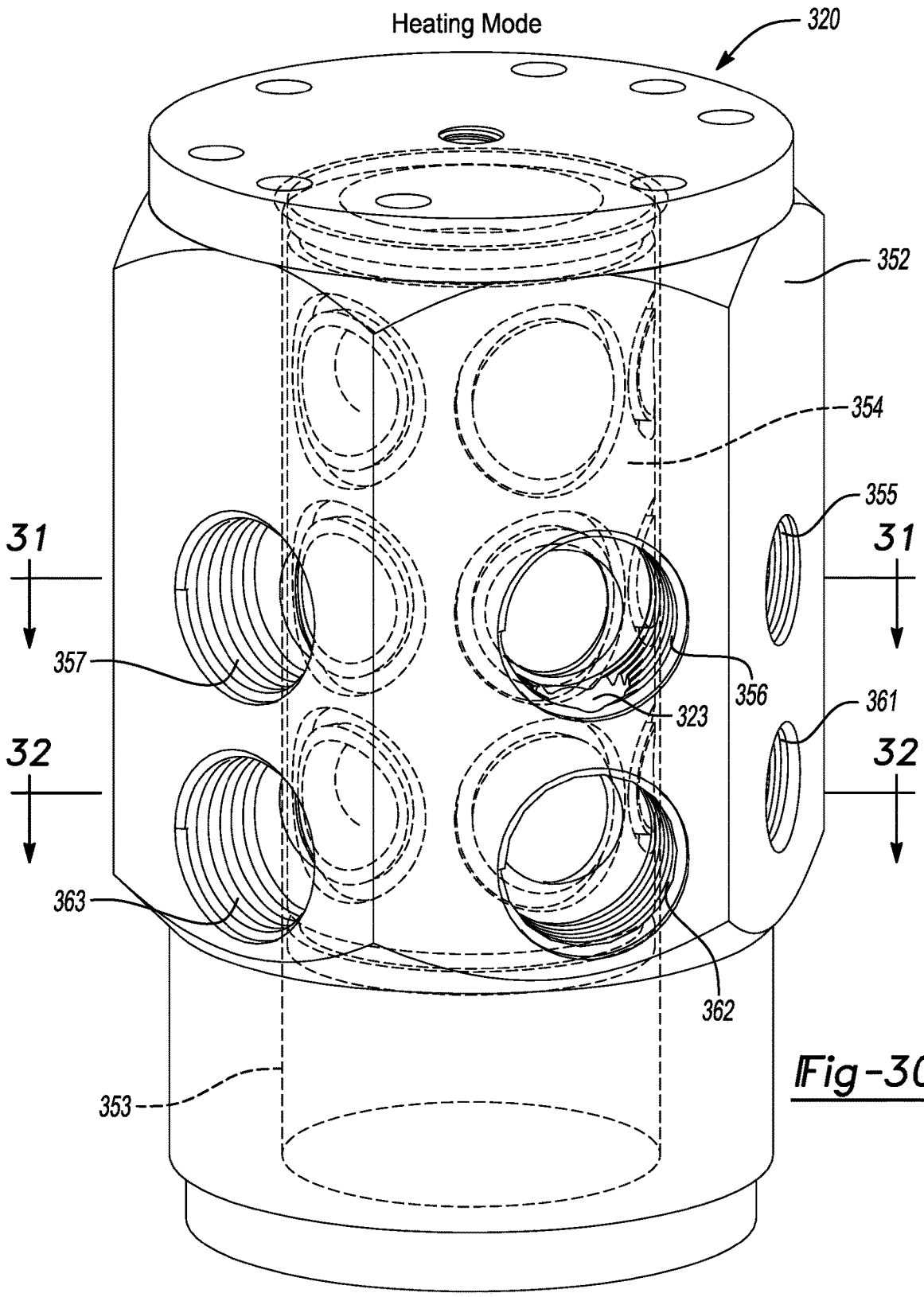
Figure 31:
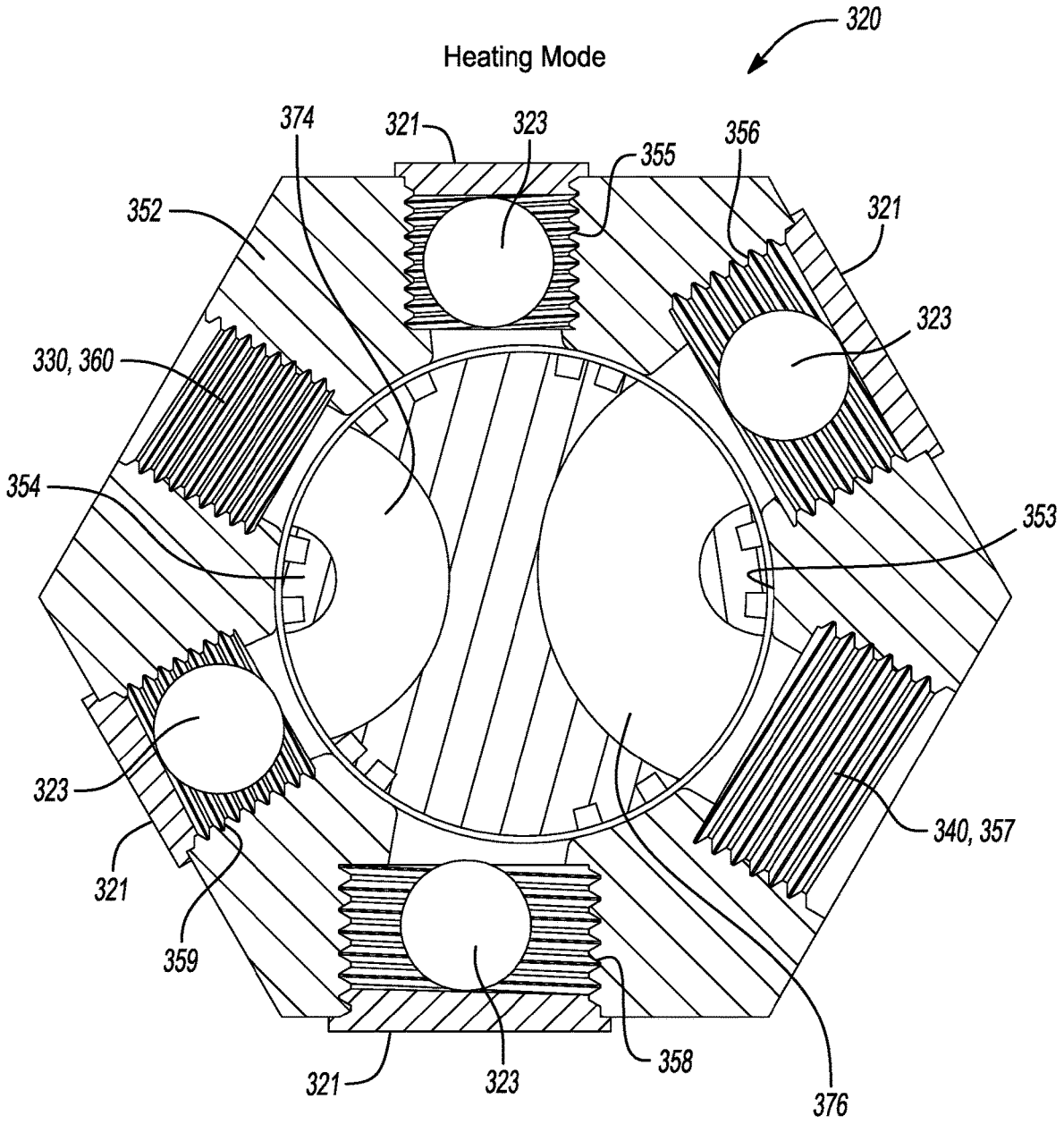
Figure 32:
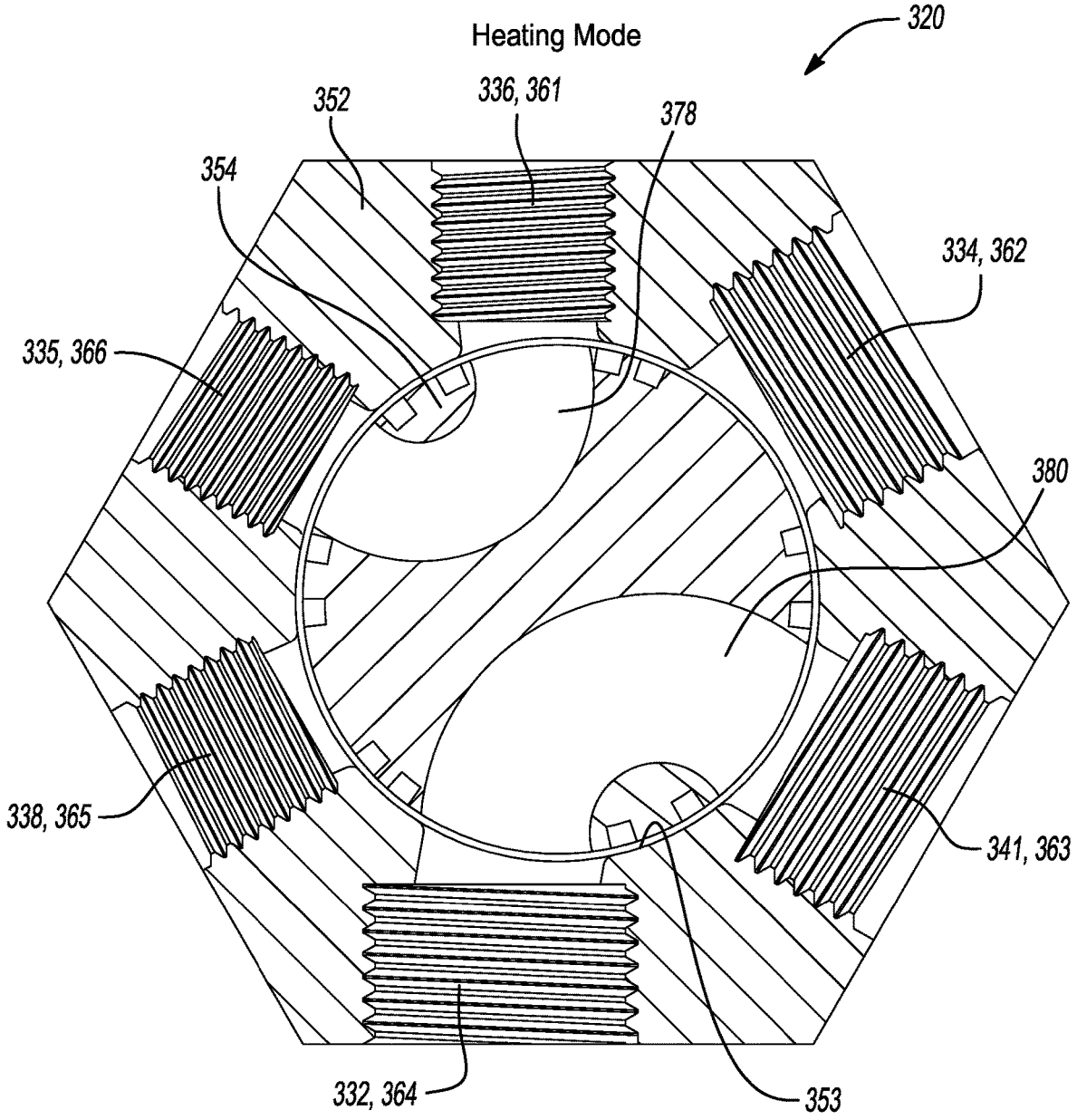

FIG. 25 a schematic representation of the heat-pump system of FIG. 24 operating in a heating mode;

FIG. 26 is a perspective view of a multiway valve of the system of FIGS. 24 and 25;

FIG. 27 is another perspective view of the multiway valve of FIG. 26 in a first position corresponding to the cooling mode;

FIG. 28 is a cross-sectional view of the multiway valve taken along line 28-28 of FIG. 27;

FIG. 29 is a cross-sectional view of the multiway valve taken along line 29-29 of FIG. 27;

FIG. 30 is another perspective view of the multiway valve of FIG. 26 in a second position corresponding to the heating mode;

FIG. 31 is a cross-sectional view of the multiway valve taken along line 31-31 of FIG. 30; and FIG. 32 is a cross-sectional view of the multiway valve taken along line 32-32 of FIG. 30.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example terms "below" or "lower" can encompass both an orientation of above and below (or upper and lower). The device may be otherwise oriented (rotated 90 degrees or at other orientations) and the spatially relative descriptors used herein interpreted accordingly.

Figure 1:
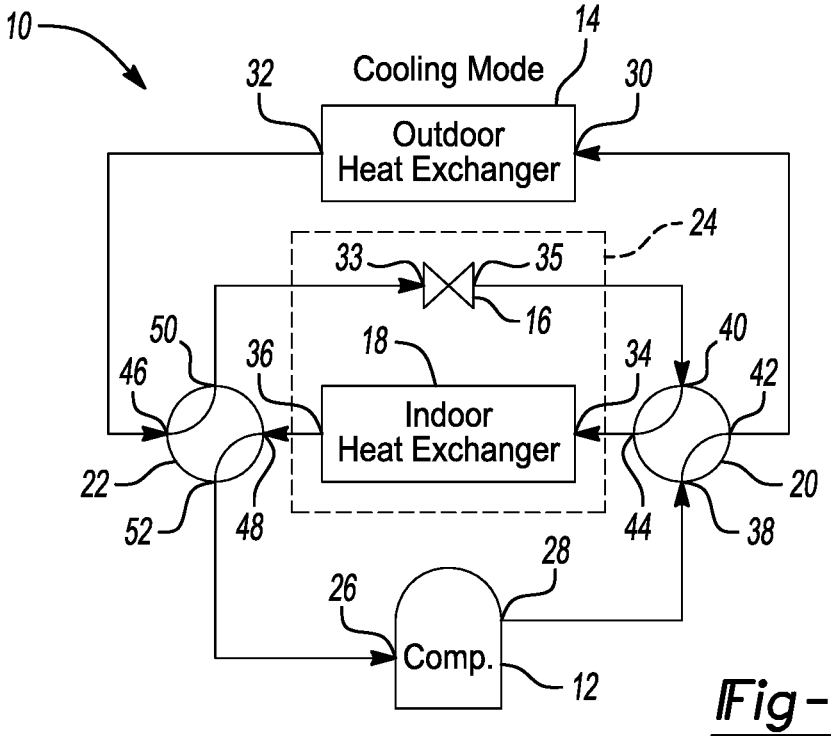
FIG. 1 is a schematic representation of a heat-pump system operating in a cooling mode.
Figure 2:
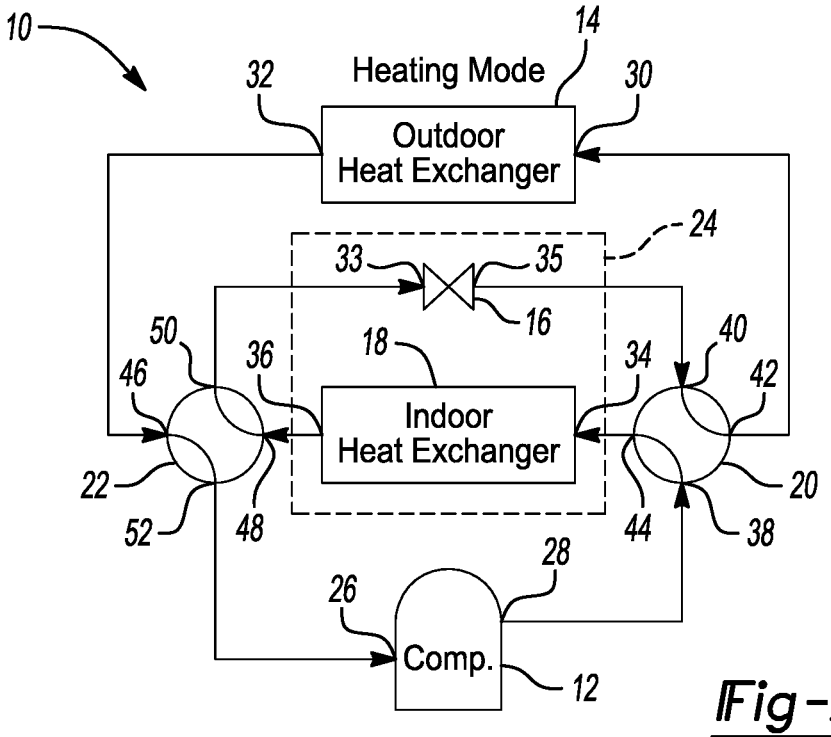
FIG. 2 is a schematic representation of the heat-pump system of FIG. 1 operating in a heating mode.
Figure 3:
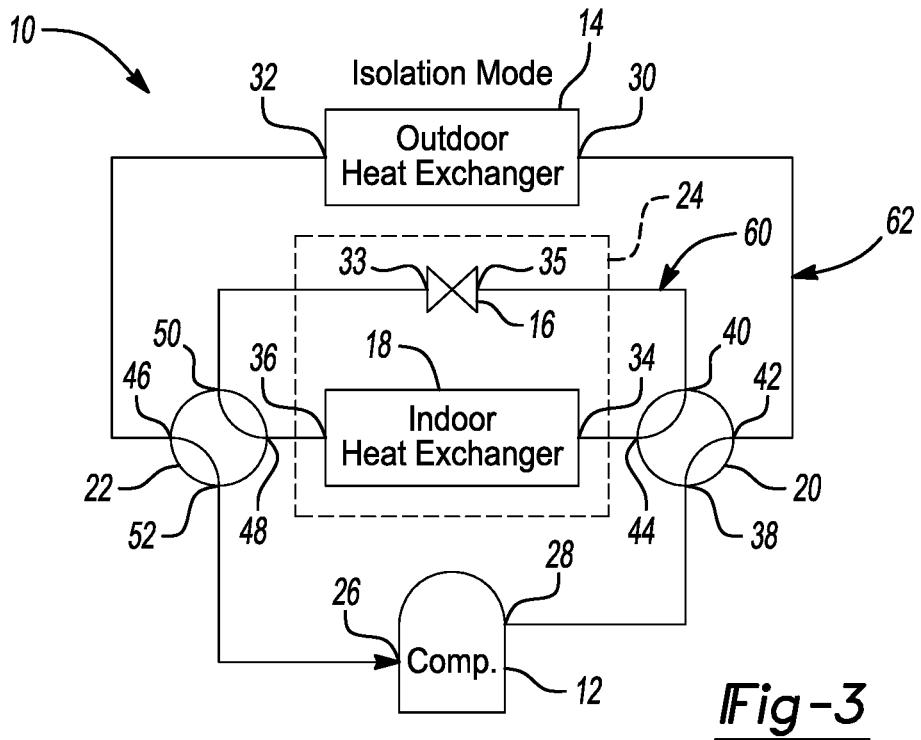
FIG. 3 is a schematic representation of the heat-pump system of FIG. 1 in an isolation mode.

With reference to FIGS. 1-3, a heat-pump system 10 is provided that may include a compressor 12, an outdoor heat exchanger 14, an expansion device 16, an indoor heat exchanger 18, a first multiway valve (reversing valve) 20, and a second multiway valve (reversing valve) 22. The indoor heat exchanger 18 may be disposed indoors (i.e., inside of a home or building 24), and the compressor 12 and outdoor heat exchanger may be disposed outdoors (i.e., outside of the home or building 24). The expansion device 16 and the valves 20, 22 may be disposed outdoors or indoors.

The heat-pump system 10 may be operable in a cooling mode (FIG. 1) and in a heating mode (FIG. 2). As shown in FIG. 3, the heat-pump system 10 can also be in an isolation mode when the compressor 12 is off or non-operational (e.g., when the system 10 is not operating). As will be described below, working fluid circulating through the system 10 may flow through the outdoor heat exchanger 14 in the same direction in the heating and cooling modes, and the working fluid may flow through the indoor heat exchanger 18 in the same direction in the heating and cooling modes. Furthermore, working fluid may flow through the expansion device 16 in the same direction in the heating and cooling modes.

The compressor 12 may pump the working fluid (e.g., an A2L refrigerant, non-azeotropic blends, azeotropic blends, an HFC refrigerant, carbon dioxide, or ammonia, for example) through the heat-pump system 10 in the heating and cooling modes. The compressor 12 could be a scroll compressor (including first and second scrolls with intermeshing spiral wraps), for example, or any other type of compressor such as reciprocating (including a piston reciprocatingly received in a cylinder) or rotary vane compressor (including a rotor rotating within a cylinder), for example. The compressor 12 could be a variable-capacity compressor operable in full capacity mode and a reduced capacity mode. In some configurations, the compressor 12 could include additional or alternative capacity modulation capabilities (e.g., variable-speed motor, vapor injection, blocked suction, etc.). The compressor 12 may include a suction inlet 26 and a discharge outlet 28. Working fluid received through the inlet 26 is compressed (by the compression mechanism) in the compressor 12 and is discharged through the outlet 28.

The outdoor heat exchanger 14 may include a coil (or conduit) having an inlet 30 and an outlet 32. A fan may force air across the coil to facilitate heat transfer between outdoor ambient air and working fluid flowing through the coil between the inlet 30 and outlet 32. The expansion device 16 may be an expansion valve or a capillary tube, for example, and includes an inlet 33 and an outlet 35. The indoor heat exchanger 18 may include a coil (or conduit) having an inlet 34 and an outlet 36, and a fan may force air across the coil to facilitate heat transfer between indoor air and working fluid flowing through the coil between the inlet 34 and outlet 36.

The first and second valves 20, 22 are movable between a first position (FIG. 1) corresponding to the cooling mode of the system 10 and a second position (FIG. 2) corresponding to the heating mode of the system 10. When the system 10 is in the isolation mode (FIG. 3), the first valve 20 is in the first position and the second valve 22 is in the second position. Movement of the first and second valves 20, 22 between the first and second positions switches the system 10 among the cooling, heating, and isolation modes. Each of the first and second valves 20, 22 can include a movable valve member (e.g., a slidable body or a rotatable body) that is movable between the first and second positions and can be actuated by a solenoid, stepper motor, or other electromechanical actuator. A control module controls operation of the first and second valves 20, 22 and controls movement between the first and second positions. The control module may also control operation of the expansion device 16, the compressor 12, and the fans of the outdoor and indoor heat exchangers 14, 18.

The first valve 20 may include a first inlet 38, a second inlet 40, a first outlet 42, and a second outlet 44. The valve member of the first valve 20 is movable relative to the inlets 38, 40 and outlets 42, 44 between the first and second positions. The first inlet 38 of the first valve 20 is fluidly connected to the outlet 28 of the compressor 12 such that the first inlet 38 receives working fluid discharged from the compressor through the outlet 28. The second inlet 40 of the first valve 20 is fluidly connected to the outlet 35 of the expansion device 16 such that the second inlet 40 receives working fluid from the expansion device 16. The first outlet 42 of the first valve 20 is fluidly connected to the inlet 30 of the outdoor heat exchanger 14 such that the outdoor heat exchanger 14 receives working fluid from the first outlet 42. The second outlet 44 of the first valve 20 is fluidly connected to the inlet 34 of the indoor heat exchanger 18 such that the indoor heat exchanger 18 receives working fluid from the second outlet 44.

The second valve 22 may include a first inlet 46, a second inlet 48, a first outlet 50, and a second outlet 52. The valve member of the second valve 22 is movable relative to the inlets 46, 48 and outlets 50, 52 between the first and second positions. The first inlet 46 of the second valve 22 is fluidly connected to the outlet 32 of the outdoor heat exchanger 14 such that the first inlet 46 receives working fluid discharged from the outdoor heat exchanger 14. The second inlet 48 of the second valve 22 is fluidly connected to the outlet 36 of the indoor heat exchanger 18 such that the second inlet 8 receives working fluid from the indoor heat exchanger 18. The first outlet 50 of the second valve 22 is fluidly connected to the inlet 33 of the expansion device 16 such that the expansion device 16 receives working fluid from the first outlet 50. The second outlet 52 of the second valve 22 is fluidly connected to the inlet 26 of the compressor 12 such that the compressor 12 receives working fluid from the second outlet 52.

When the heat-pump system 10 is in the cooling mode (FIG. 1): (a) the first valve 20 allows the first inlet 38 of the first valve 20 to be fluidly connected with the first outlet 42 of the first valve 20, (b) the first valve 20 allows the second inlet 40 of the first valve 20 to be fluidly connected with the second outlet 44 of the first valve 20, (c) the second valve 22 allows the first inlet 46 of the second valve 22 to be fluidly connected with the first outlet 50 of the second valve 22, and (d) the second valve 22 allows the second inlet 48 of the second valve 22 to be fluidly connected with the second outlet 52 of the second valve 22.

Accordingly, when the heat-pump system 10 is in the cooling mode, compressed working fluid is discharged from the compressor 12, flows into the first inlet 38 of the first valve 20 and exits the first valve 20 through the first outlet 42. From the first outlet 42, the working fluid flows into the inlet 30 of the outdoor heat exchanger 14, through the outdoor heat exchanger 14 (where heat is transferred from the working fluid to ambient outdoor air), and exits the outdoor heat exchanger 14 through the outlet 32. From the outdoor heat exchanger 14, the working fluid flows into first inlet 46 of the second valve 22 and exits the second valve 22 through the first outlet 50. From the first outlet 50, the working fluid flows into the inlet 33 of the expansion device 16. As the working fluid flows through the expansion device 16, the temperature and pressure of the working fluid are lowered. From the outlet 35 of the expansion device 16, the working fluid flows into the second inlet 40 of the first valve 20 and exits the first valve 20 through the second outlet 44. From the second outlet 44, the working fluid flows into the inlet 34 of the indoor heat exchanger 18, through the indoor heat exchanger 18 (where heat is transferred to the working fluid from a space within the building 24), and exits the indoor heat exchanger 18 through the outlet 36. From the indoor heat exchanger 18, the working fluid flows into second inlet 48 of the second valve 22 and exits the second valve 22 through the second outlet 52. From the second outlet 52, the working fluid flows into the inlet 26 of the compressor 12. The working fluid is then compressed in the compressor 12 and the cycle described above can repeat.

When the heat-pump system 10 is in the heating mode (FIG. 2): (a) the first valve 20 allows the first inlet 38 of the first valve 20 to be fluidly connected with the second outlet 44 of the first valve 20, (b) the first valve 20 allows the second inlet 40 of the first valve 20 to be fluidly connected with the first outlet 42 of the first valve 20, (c) the second valve 22 allows the first inlet 46 of the second valve 22 to be fluidly connected with the second outlet 52 of the second valve 22, and (d) the second valve 22 allows the second inlet 48 of the second valve 22 to be fluidly connected with the first outlet 50 of the second valve 22.

Accordingly, when the heat-pump system 10 is in the heating mode, compressed working fluid is discharged from the compressor 12, flows into the first inlet 38 of the first valve 20 and exits the first valve 20 through the second outlet 44. From the second outlet 44, the working fluid flows into the inlet 34 of the indoor heat exchanger 18, through the indoor heat exchanger 18 (where heat is transferred from the working fluid to the space within the building 24), and exits the indoor heat exchanger 18 through the outlet 36. From the indoor heat exchanger 18, the working fluid flows into second inlet 48 of the second valve 22 and exits the second valve 22 through the first outlet 50. From the first outlet 50, the working fluid flows into the inlet 33 of the expansion device 16. As the working fluid flows through the expansion device 16, the temperature and pressure of the working fluid are lowered. From the outlet 35 of the expansion device 16, the working fluid flows into the second inlet 40 of the first valve 20 and exits the first valve 20 through the first outlet 42. From the first outlet 42, the working fluid flows into the inlet 30 of the outdoor heat exchanger 14, through the outdoor heat exchanger 14 (where the working fluid is in a heat transfer relationship with the ambient outdoor air), and exits the outdoor heat exchanger 14 through the outlet 32. From the outdoor heat exchanger 14, the working fluid flows into first inlet 46 of the second valve 22 and exits the second valve 22 through the second outlet 52. From the second outlet 52, the working fluid flows into the inlet 26 of the compressor 12. The working fluid is then compressed in the compressor 12 and the cycle described above can repeat.

As described above, the direction of fluid flow through the outdoor heat exchanger 14 is the same in the cooling mode and in the heating mode. That is, as shown in FIGS. 1 and 2, fluid flows into the outdoor heat exchanger 14 through the inlet 30 and exits the outdoor heat exchanger 14 through the outlet 32. Stated yet another way, the opening of the outdoor heat exchanger 14 designated as the "inlet" of the outdoor heat exchanger 14 is the same opening in the heating and cooling modes, and the opening of the outdoor heat exchanger 14 designated as the "outlet" of the outdoor heat exchanger 14 is the same opening in the heating and cooling modes.

The same is true for the indoor heat exchanger 18—i.e., the direction of fluid flow through the indoor heat exchanger 18 is the same in the cooling mode and in the heating mode. That is, as shown in FIGS. 1 and 2, fluid flows into the indoor heat exchanger 18 through the inlet 34 and exits the indoor heat exchanger 18 through the outlet 36. Stated yet another way, the opening of the indoor heat exchanger 18 designated as the "inlet" of the indoor heat exchanger 18 is the same opening in the heating and cooling modes, and the opening of the indoor heat exchanger 18 designated as the "outlet" of the indoor heat exchanger 18 is the same opening in the heating and cooling modes.

Having the fluid flow through the heat exchangers 14, 18 in the same directions in both the heating and cooling modes allows for optimized heat transfer in both modes. Having the direction of working fluid flow be counter (or opposite) the direction of the flow of air forced across the heat exchangers 14, 18 by their respective fans improves heat transfer. By having the working fluid flow in the same direction through the heat exchangers 14, 18 in the heating and cooling modes, the direction of working fluid flow can be counter to the direction of airflow in both modes. This improved heat transfer between the air and working fluid improves the efficiency of the heat-pump system 10.

Furthermore, as shown in FIGS. 1 and 2, the direction of fluid flow through the expansion device 16 is the same in the cooling mode and in the heating mode. That is, fluid flows into the expansion device 16 through the inlet 33 and exits the expansion device 16 through the outlet 35. Stated yet another way, the opening of the expansion device 16 designated as the "inlet" of the expansion device 16 is the same opening in the heating and cooling modes, and the opening of the expansion device 16 designated as the "outlet" of the expansion device 16 is the same opening in the heating and cooling modes. Furthermore, because the working fluid flows through the heat exchangers 14, 18 and expansion device 16 in the same direction in the heating and cooling modes, the system 10 can operate with only a single expansion device 16 (as opposed to prior-art heat-pump systems that have two expansion devices).

Referring now to FIG. 3, when the heat-pump system 10 is in the isolation mode, the first valve 20 is in the first position (i.e., the same position as the cooling mode) and the second valve 22 is in the second position (i.e., the same position as the heating mode). That is, in the isolation mode: (a) the first valve 20 allows the first inlet 38 of the first valve 20 to be fluidly connected with the first outlet 42 of the first valve 20, (b) the first valve 20 allows the second inlet 40 of the first valve 20 to be fluidly connected with the second outlet 44 of the first valve 20, (c) the second valve 22 allows the first inlet 46 of the second valve 22 to be fluidly connected with the second outlet 52 of the second valve 22, and (d) the second valve 22 allows the second inlet 48 of the second valve 22 to be fluidly connected with the first outlet 50 of the second valve 22.

Accordingly, when the heat-pump system 10 is in the isolation mode, the first and second valves 20, 22 fluidly isolate the indoor components (e.g., the indoor heat exchanger 18 and expansion device 16) from the outdoor components (e.g., the outdoor heat exchanger 14 and the compressor 12). In the example shown in FIG. 3, the system 10 is separated into two fluidly separate fluid loops or circuits—i.e., an indoor loop 60 that is fluidly isolated from an outdoor loop 62. The indoor loop 60 includes the expansion device 16, the indoor heat exchanger 18, a pathway through the first valve 20 connecting the second inlet 40 with the second outlet 44, and a pathway through the second valve 22 connecting the second inlet 48 with the first outlet 50. The outdoor loop 62 includes the outdoor heat exchanger 14, the compressor 12, a pathway through the first valve 20 connecting the first inlet 38 with the first outlet 42, and a pathway through the second valve 22 connecting the first inlet 46 with the second outlet 52.

By keeping the indoor and outdoor loops 60, 62 fluidly separated from each other in the isolation mode, the valves 20, 22 lower the amount of working fluid that is within the building 24 (i.e., the amount of working fluid in the indoor loop 60) that could possibly leak within the building 24 when the compressor 12 is non-operational. That is, a portion of the system's working fluid contained in the outdoor loop 62 during the isolation mode is isolated from the interior of the building 24, and therefore cannot leak into the building 24. This is particularly beneficial when the working fluid is an A2L (or mildly flammable) working fluid.

Figure 4:
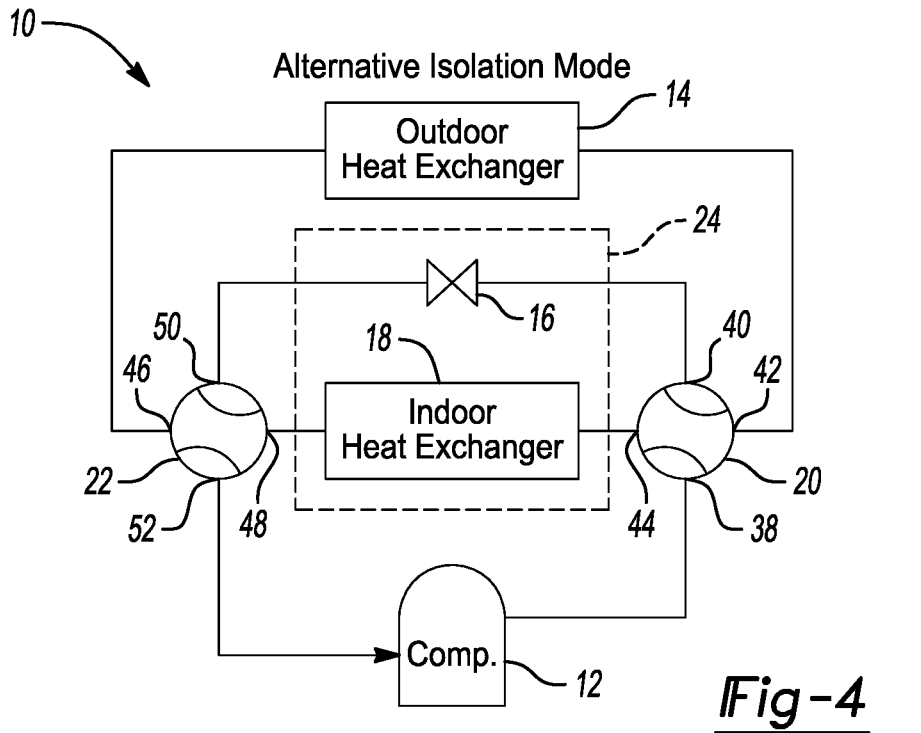
FIG. 4 is a schematic representation of the heat-pump system of FIG. 1 in an alternative isolation mode.

FIG. 4 depicts an alternative isolation mode for the heat-pump system 10 in which the valves 20, 22 are movable to a third position. In the third position, none of the inlets 38, 40 of the first valve 20 is in fluid communication with each other or with either of the outlets 42, 44, and none of the inlets 46, 48 of the second valve 22 is in fluid communication with each other or with either of the outlets 50, 52. In this manner, the compressor 12, the outdoor heat exchanger 14, the expansion device 16, and the indoor heat exchanger 18 are all fluidly isolated from each other, thereby lowering the amount of working fluid that could possibly leak into the interior of the building 24.

Figure 5:
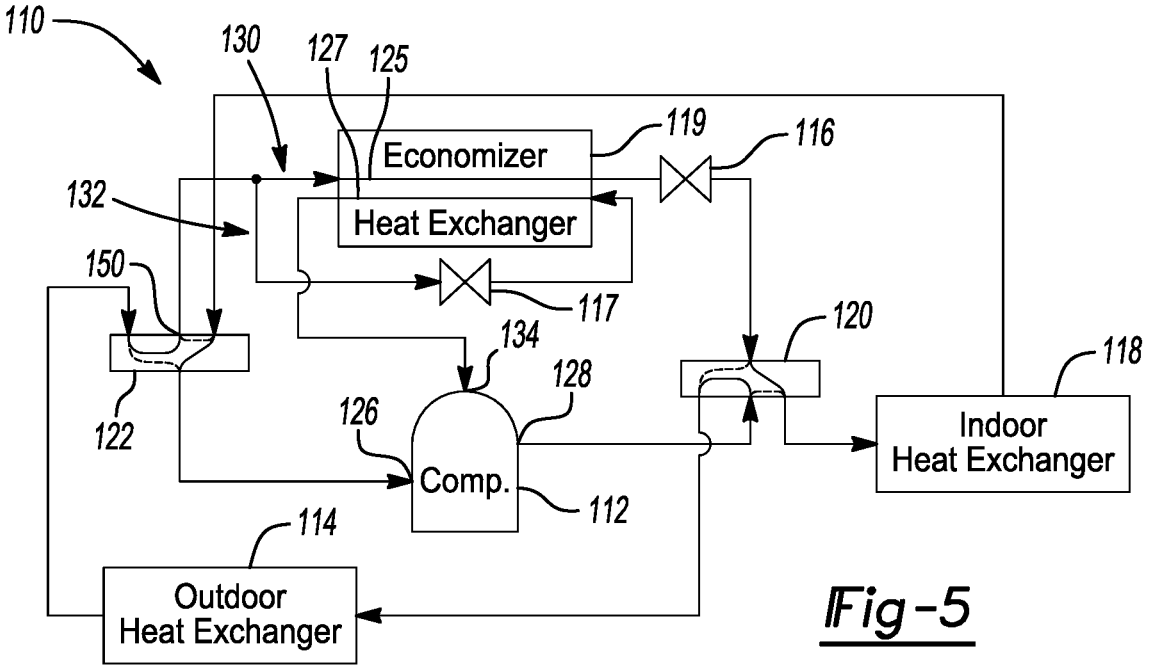
FIG. 5 is a schematic representation of a heat-pump system with economized vapor injection.

Referring now to FIG. 5, another heat-pump system 110 is provided. The structure and function of the system 110 may be similar or identical to that of the system 10 described above, apart from differences described below. The system 110 may include a compressor 112, an outdoor heat exchanger 114, a first expansion device 116, a second expansion device 117, an indoor heat exchanger 118, an economizer heat exchanger 119, a first multiway valve (reversing valve) 120, and a second multiway valve (reversing valve) 122. Like the system 10, the system 110 may be operable in a cooling mode and in a heating mode. The system 110 can also be in an isolation mode when the compressor 112 is off or non-operational. As in the system 10, working fluid circulating through the system 110 may flow through the outdoor heat exchanger 114 in the same direction in the heating and cooling modes, and the working fluid may flow through the indoor heat exchanger 118 in the same direction in the heating and cooling modes. Furthermore, working fluid may flow through the first expansion device 116 in the same direction in the heating and cooling modes, and working fluid may flow through the second expansion device 117 in the same direction in the heating and cooling modes. The economizer heat exchanger 119 includes first and second conduits (or coils) 125, 127. Working fluid may flow through the first conduit 125 in the same direction in the heating and cooling modes, and working fluid may flow through the second conduit 127 in the same direction in the heating and cooling modes.

As with the valves 20, 22 described above, the valves 120, 122 are movable between a first position (corresponding to the cooling mode) and a second position (corresponding to the heating mode). FIG. 5 shows fluid connections between inlets and outlets of the valves 120, 122 in solid lines for the cooling mode and in dashed lines for the heating mode. The structure and function of the valves 120, 122 can be similar or identical to that of the valves 20, 22, and therefore, similar features will not be described again in detail.

The system 110 includes first and second flow paths 130, 132 between the first and second valves 120, 122. The first flow path 130 includes the first conduit 125 of the economizer heat exchanger 119 and the first expansion device 116 (an expansion valve or capillary tube). The second flow path 132 includes the second conduit 127 of the economizer heat exchanger 119 and the second expansion device 117 (an expansion valve or capillary tube). The first and second flow paths 130, 132 split apart from each other downstream of outlet 150 of the second valve 122. During operation of the system 110 in either the heating mode or the cooling mode, a first portion of the working fluid from outlet 150 of the second valve 122 may flow into the first flow path 130, and a second portion of the working fluid from outlet 150 may flow into the second flow path 132. The working fluid flowing through the first flow path 130 flows through the first conduit 125 and the first expansion device 116 and into the first valve 120. The working fluid flowing through the second flow path 132 flows through the second conduit 127 and the second expansion device 117 and into fluid-injection port 134 of the compressor 112. The first and second conduits 125, 127 are in a heat transfer relationship with each other such that working fluid in the second conduit 127 absorbs heat from working fluid in the first conduit 125. The first and second expansion valves 116, 117 can be opened and closed to adjust the amounts of working fluid allowed to flow through the first and second flow paths 130, 132.

The fluid-injection port 134 of the compressor 112 may be fluidly coupled with an intermediate-pressure location of the compression mechanism of the compressor 112. For example, the fluid-injection port 134 could be connected to a fluid-injection passage in a scroll of the compressor 112.

The fluid-injection passage could in communication with an intermediate-pressure compression pocket.

Figure 6:
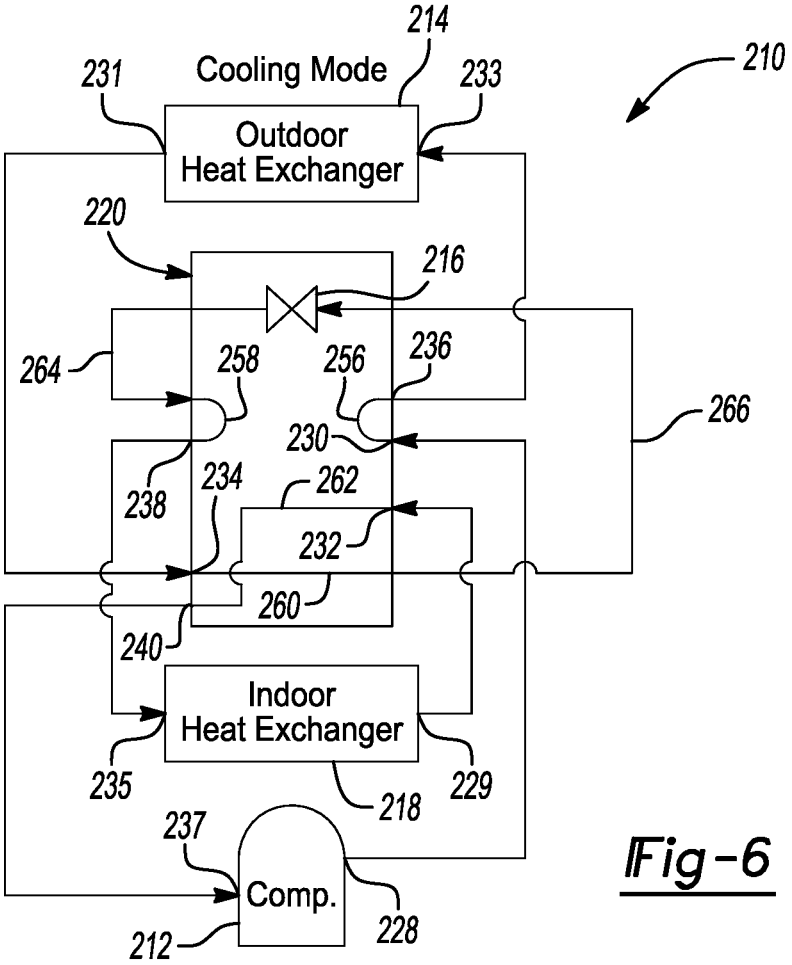
FIG. 6 is a schematic representation of yet another heat-pump system operating in a cooling mode.
Figure 7:
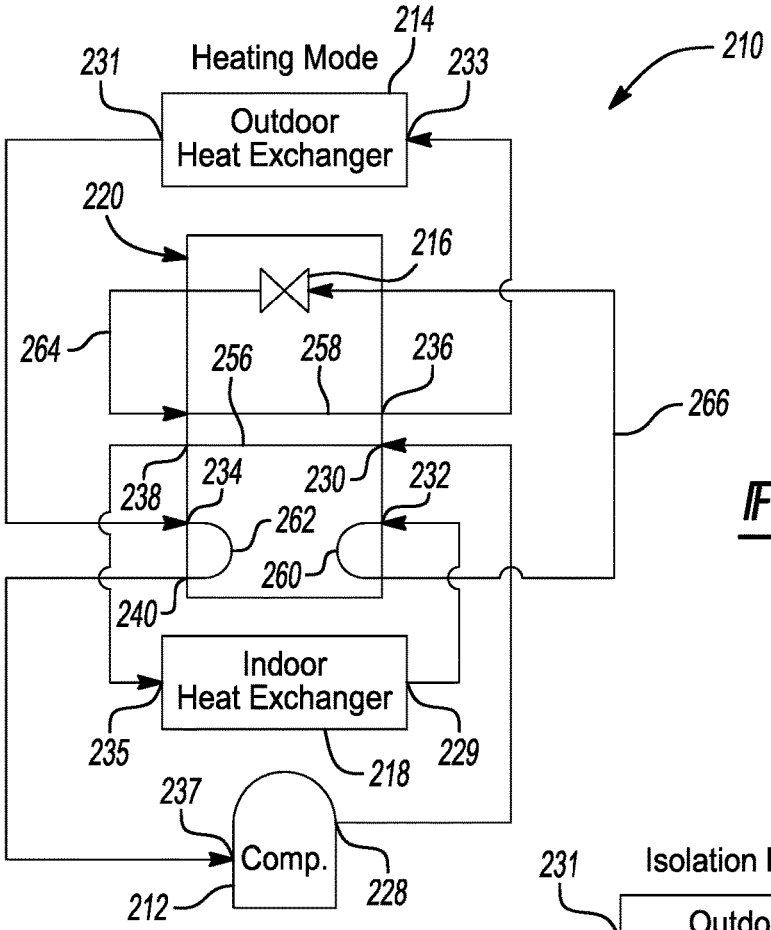
FIG. 7 is a schematic representation of the heat-pump system of FIG. 6 operating in a heating mode.
Figure 8:
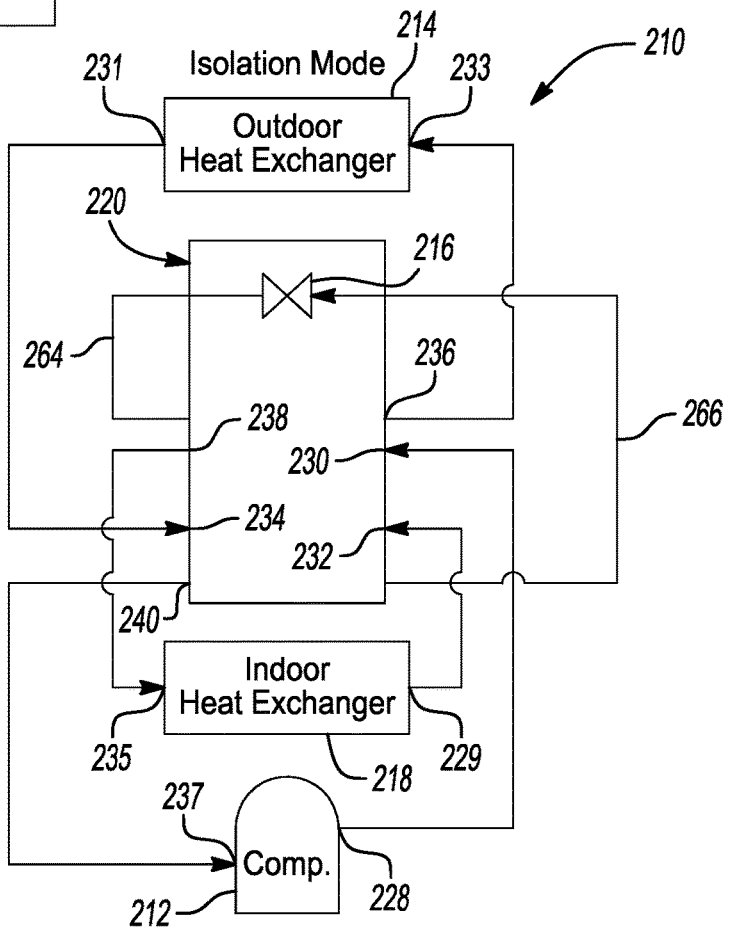
FIG. 8 is a schematic representation of the heat-pump system of FIG. 6 in an isolation mode.
Figure 9:
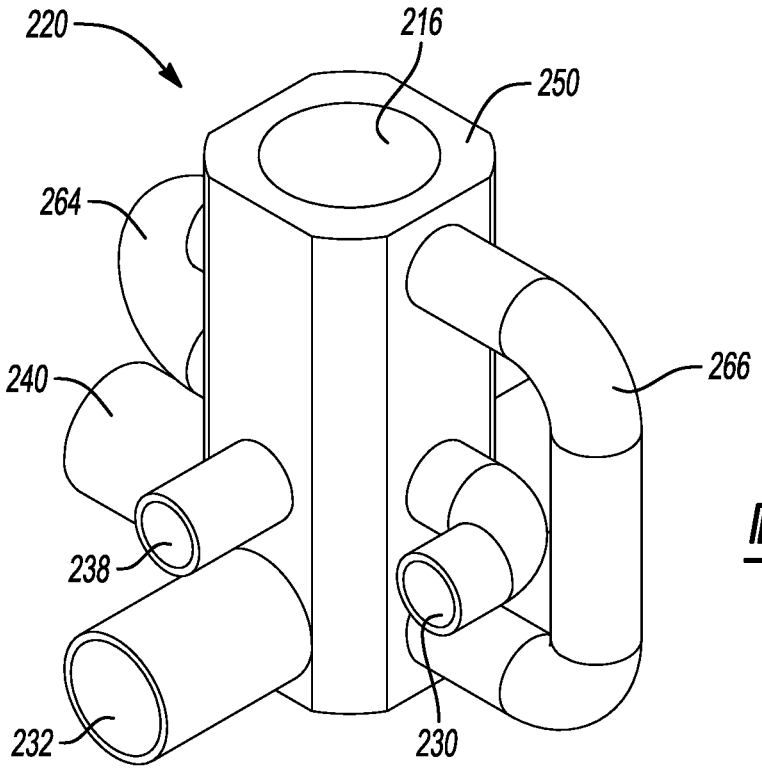
FIG. 9 is a perspective view of a multiway valve of the system of FIGS. 6-8.
Figure 10:
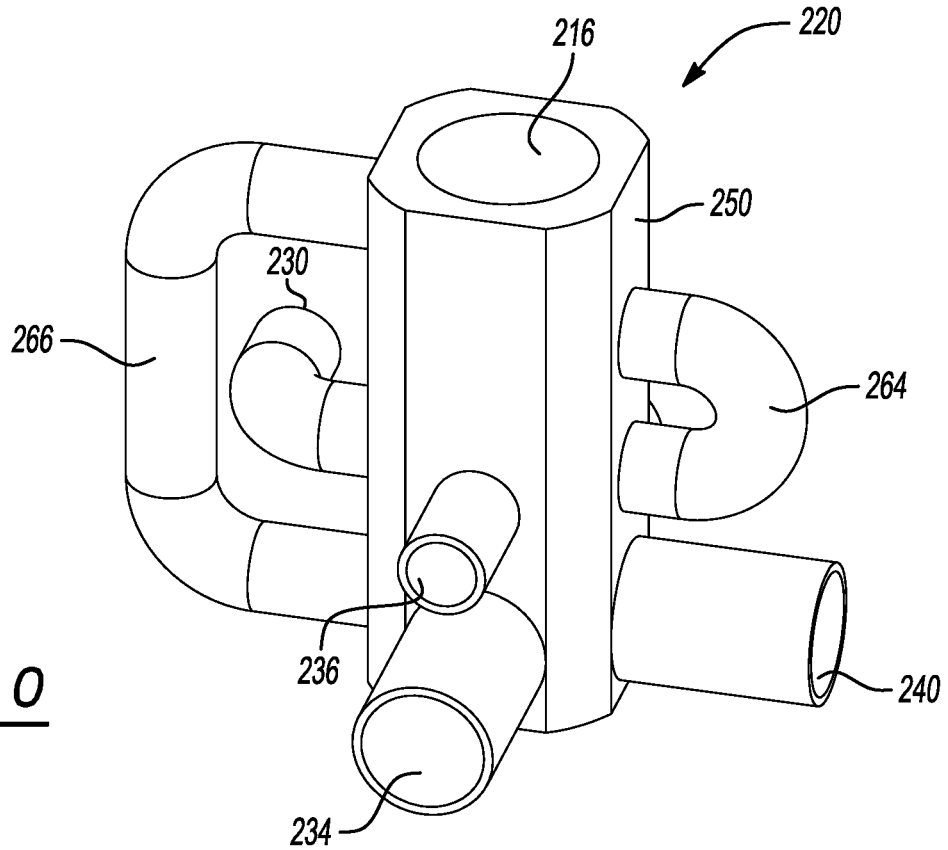
FIG. 10 is another perspective view of the multiway valve.

With reference to FIGS. 6-8, another heat-pump system 210 is provided. The system 210 may include a compressor 212, an outdoor heat exchanger 214, an expansion device 216, an indoor heat exchanger 218, and a multiway valve (reversing valve) 220. As will be described in more detail below, the expansion device 216 (e.g., an expansion valve or a capillary tube) may be integrally formed with and/or housed in the multiway valve 220.

Like the system 10, the system 210 may be operable in a cooling mode and in a heating mode. The system 210 can also be in an isolation mode when the compressor 212 is off or non-operational. As in the system 10, working fluid circulating through the system 210 may flow through the outdoor heat exchanger 214 in the same direction in the heating and cooling modes, and the working fluid may flow through the indoor heat exchanger 218 in the same direction in the heating and cooling modes. Furthermore, working fluid may flow through the expansion device 216 in the same direction in the heating and cooling modes.

The structure and function of the compressor 212, outdoor heat exchanger 214, and indoor heat exchanger 218 may be similar or identical to that of the compressor 12, outdoor heat exchanger 14, and indoor heat exchanger 18 described above.

As shown in FIGS. 6-23, the valve 220 may include a first inlet 230, a second inlet 232, a third inlet 234, a first outlet 236, a second outlet 238, and a third outlet 240. The first inlet 230 is in fluid communication with a discharge outlet 228 of the compressor 212 such that the first inlet 230 receives working fluid from the compressor 212 in the heating mode and in the cooling mode. The second inlet 232 is in fluid communication with an outlet 229 of the indoor heat exchanger 218 such that the second inlet 232 receives working fluid from the indoor heat exchanger 218 in the heating mode and in the cooling mode. The third inlet 234 is in fluid communication with an outlet 231 of the outdoor heat exchanger 214 such that the third inlet 234 receives working fluid from the outdoor heat exchanger 214 in the heating mode and in the cooling mode. The first outlet 236 is in fluid communication with an inlet 233 of the outdoor heat exchanger 214 such that the outdoor heat exchanger 214 receives working fluid from the first outlet 236 in the heating mode and in the cooling mode. The second outlet 238 is in fluid communication with an inlet 235 of the indoor heat exchanger 218 such that the indoor heat exchanger 218 receives working fluid from the second outlet 238 in the heating mode and in the cooling mode. The third outlet 240 is in fluid communication with a suction inlet 237 of the compressor 212 such that the compressor 212 receives working fluid from the third outlet 240 in the heating mode and in the cooling mode.

Referring now to FIGS. 9-23, the multiway valve 220 will be described in detail. The valve 220 includes a body 250 and a valve member 252 that is disposed within the body 250 and is movable relative to the body 250. The valve member 252 is movable (e.g., rotatable) relative to the body 250 among a first position (FIGS. 12-15) corresponding to the cooling mode, a second position (FIGS. 16-19) corresponding to the heating mode, and a third position (FIGS. 20-23) corresponding to the isolation mode. The valve member 252 may be actuated by an electric motor, a solenoid, or any other actuator.

The body 250 includes an internal cavity 254 (FIG. 11) in which the valve member 252 and the expansion device 216 are disposed. The inlets 230, 232, 234 and outlets 236, 238, 240 are formed in the body 250 and extend into the internal cavity 254. The inlets 230, 232, 234 and outlets 236, 238, 240 can include fittings extending outward from the body 250.

Figure 11:
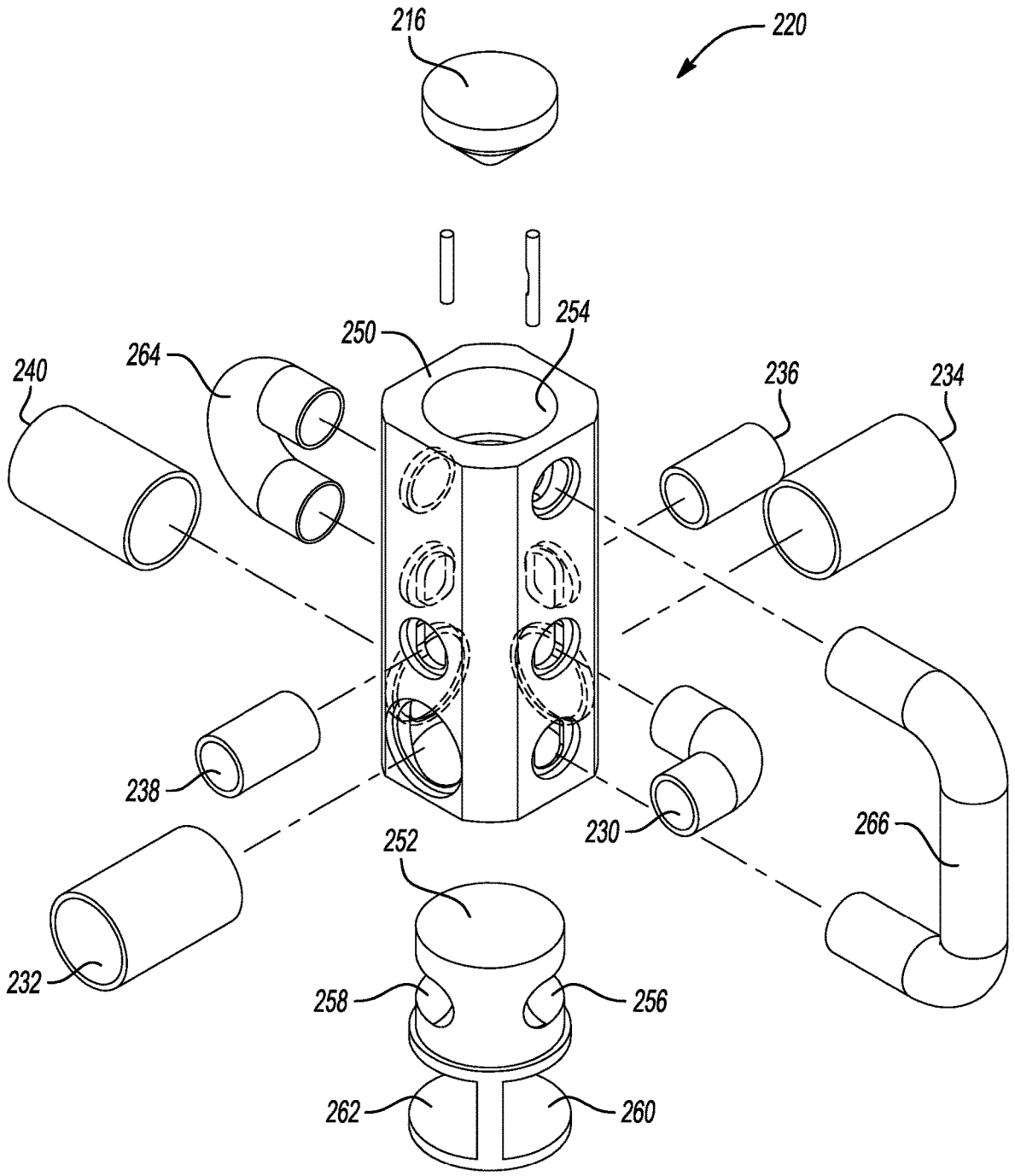
FIG. 11 is an exploded view of the multiway valve.
Figure 12:
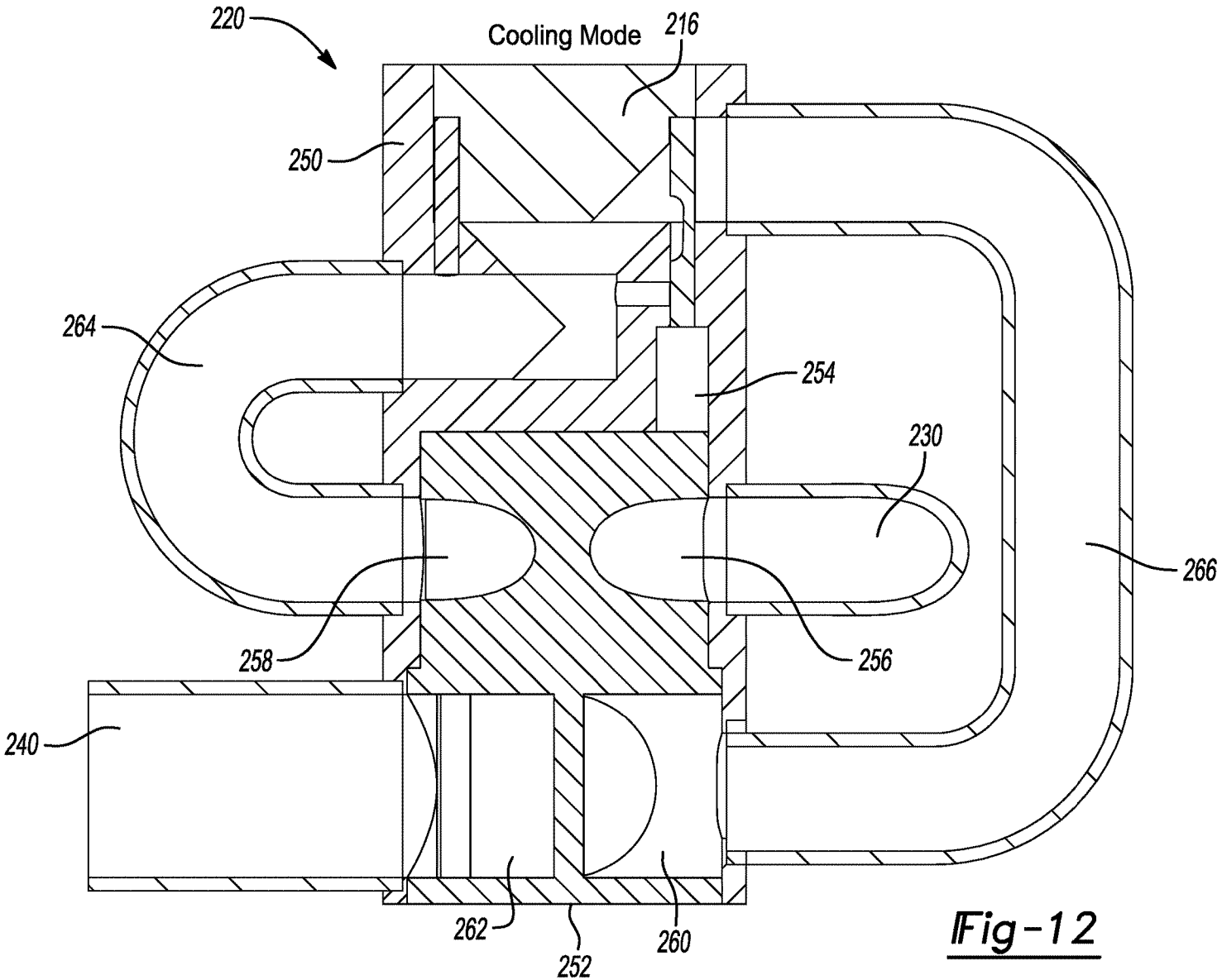
FIG. 12 is a cross-sectional view of the multiway valve in a first position corresponding to the cooling mode.
Figure 13:
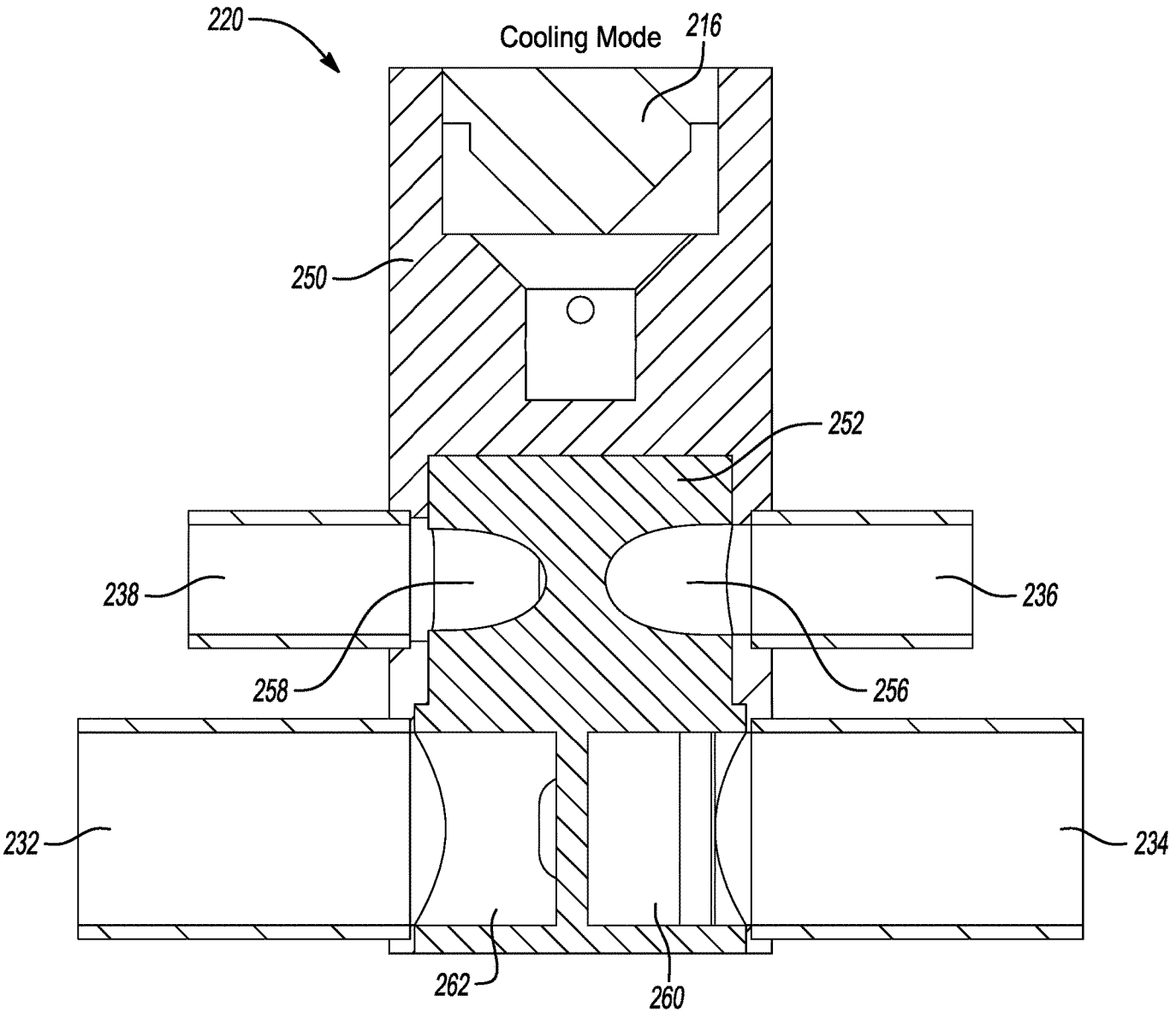
FIG. 13 is another cross-sectional view of the multiway valve in the first position corresponding to the cooling mode.
Figure 14:
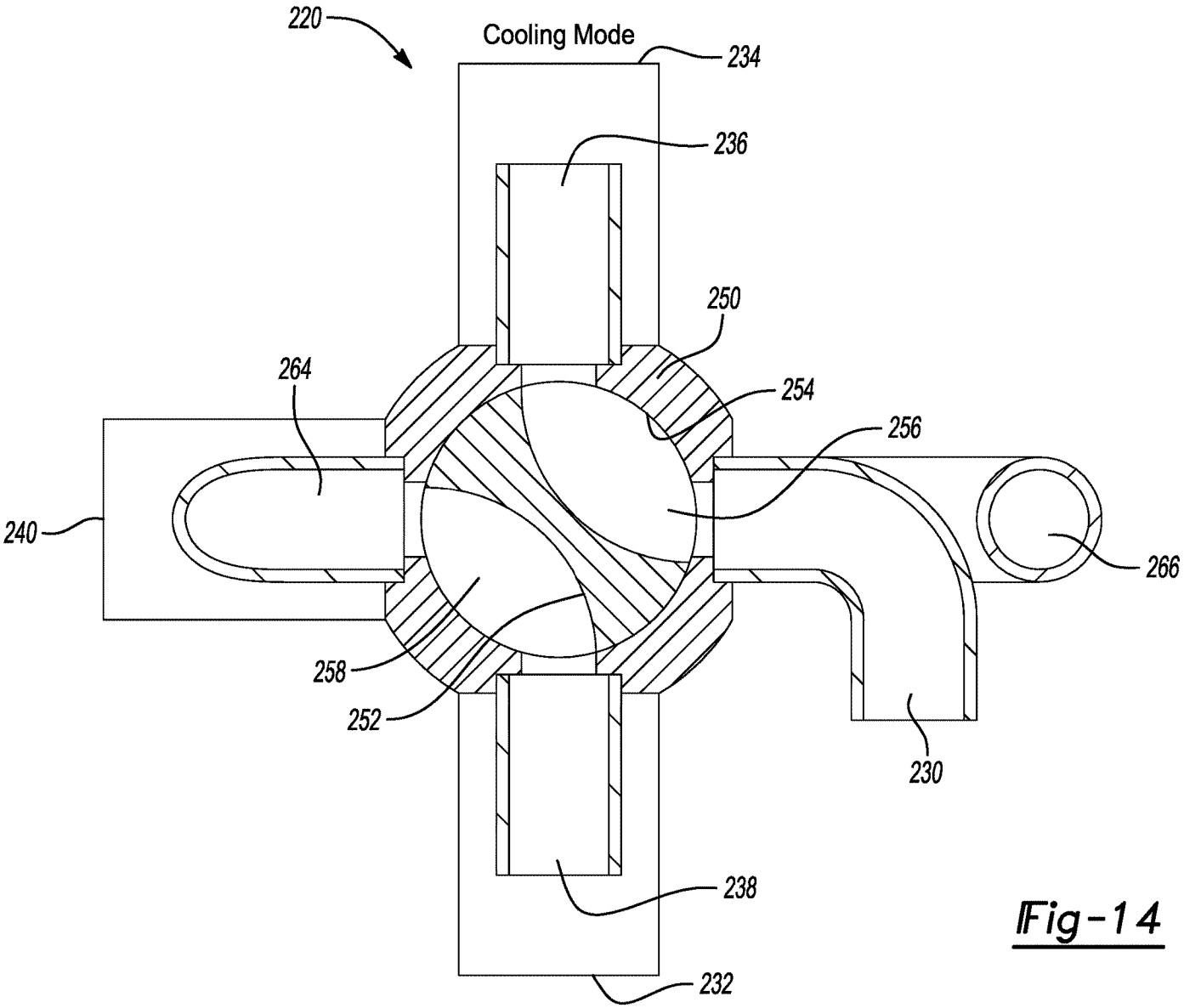
FIG. 14 is another cross-sectional view of the multiway valve in the first position corresponding to the cooling mode.
Figure 15:
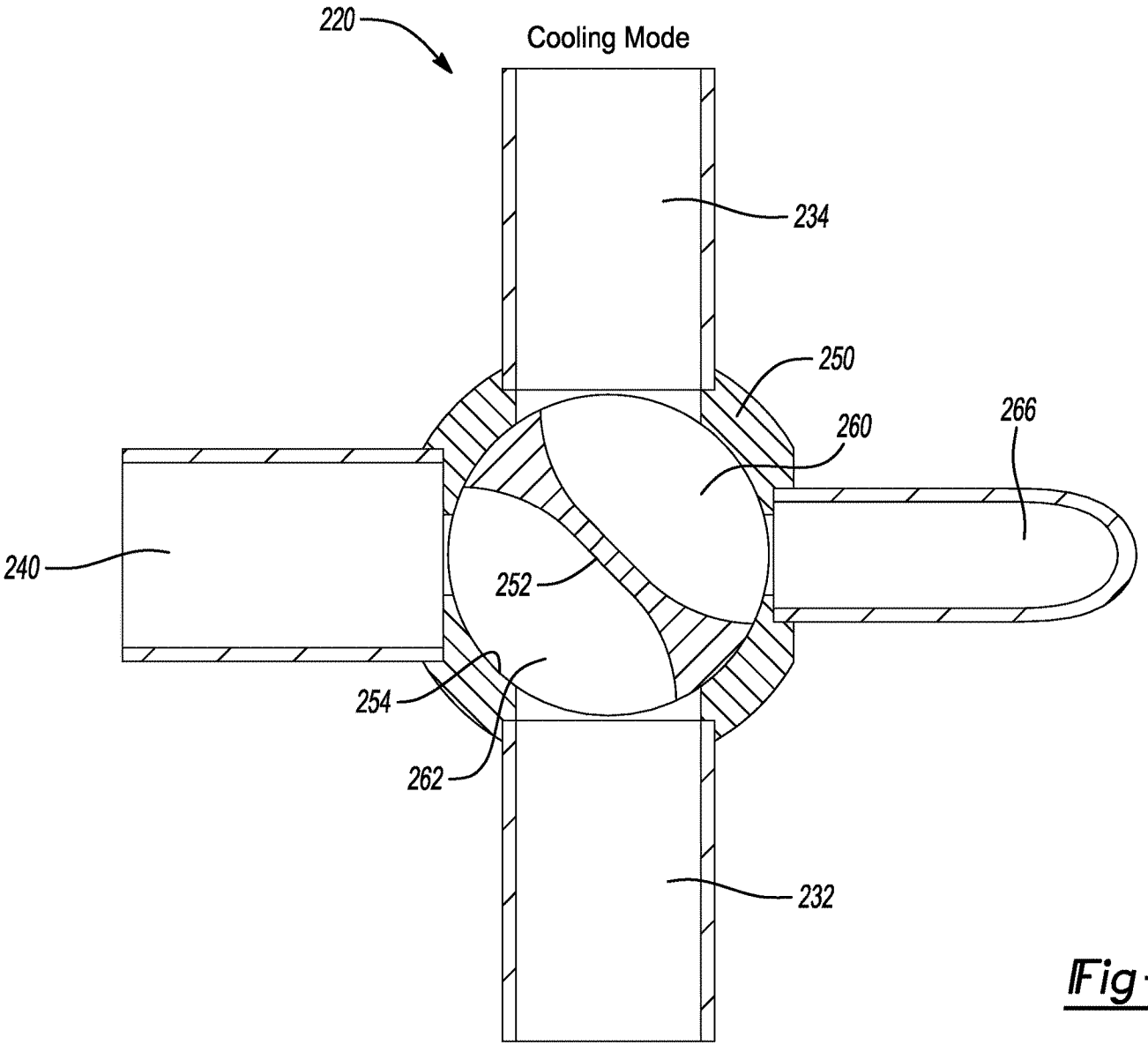
FIG. 15 is another cross-sectional view of the multiway valve in the first position corresponding to the cooling mode.
Figure 16:
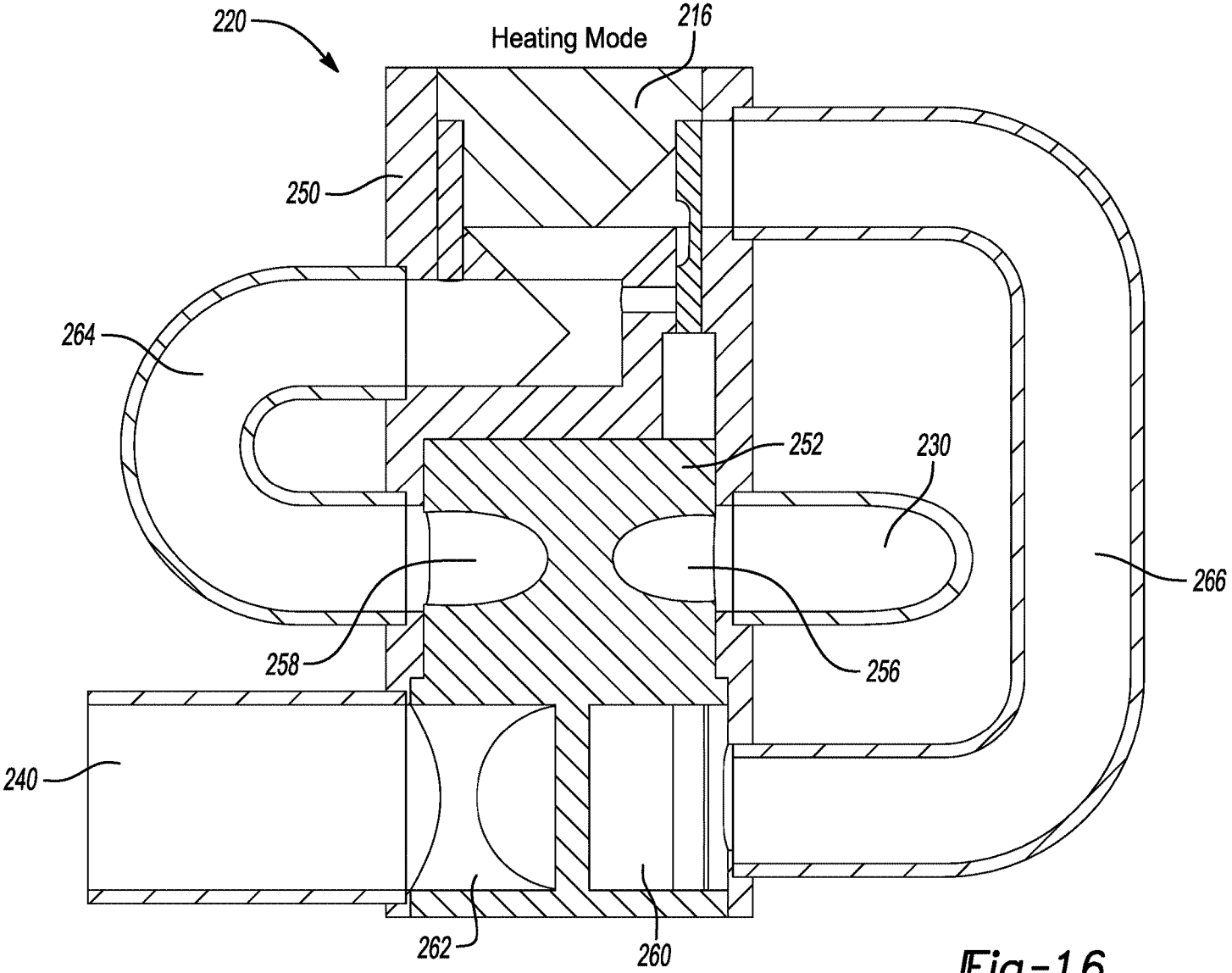
FIG. 16 is a cross-sectional view of the multiway valve in a second position corresponding to the heating mode.
Figure 17:
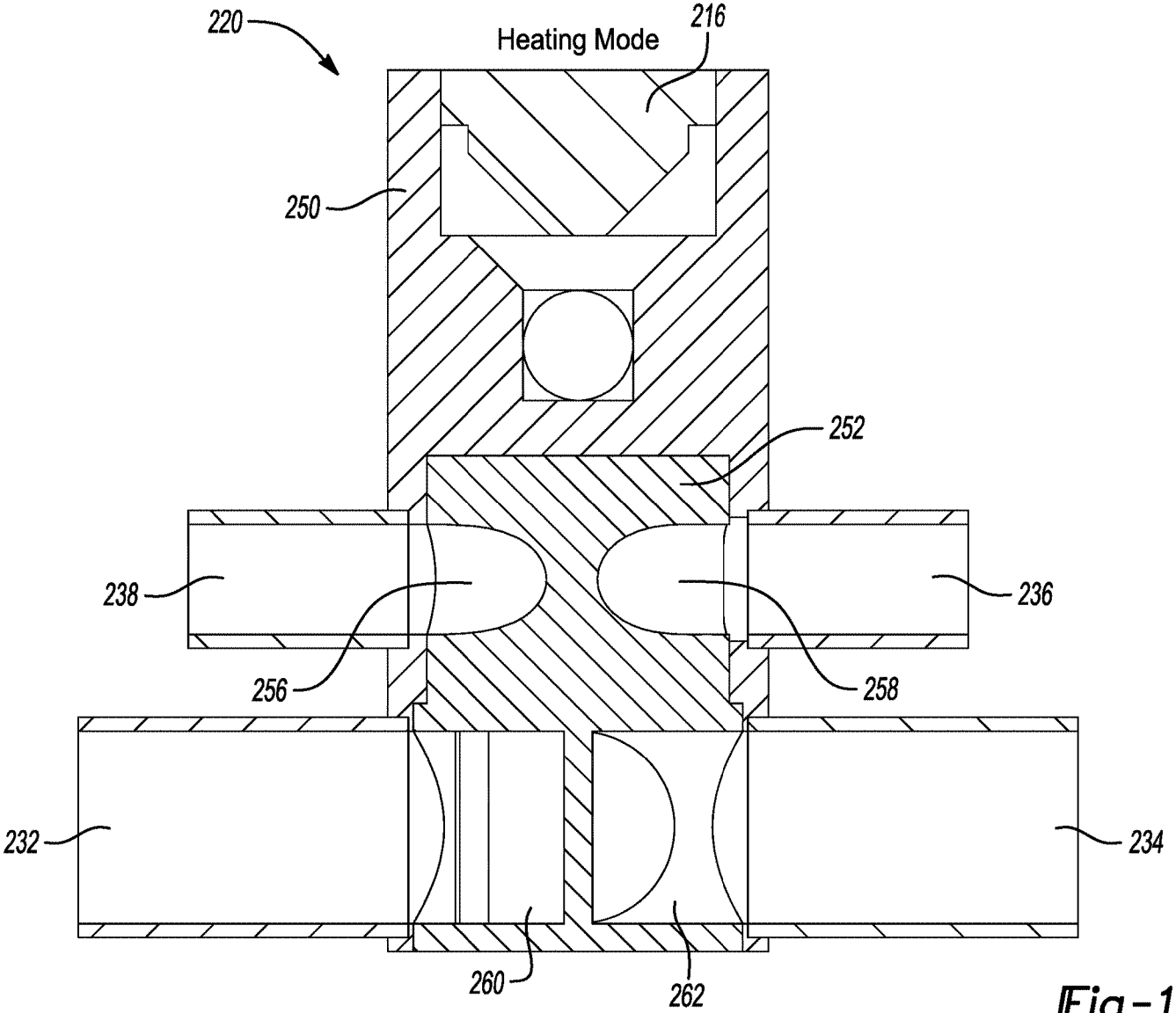
FIG. 17 is another cross-sectional view of the multiway valve in the second position corresponding to the heating mode.
Figure 18:
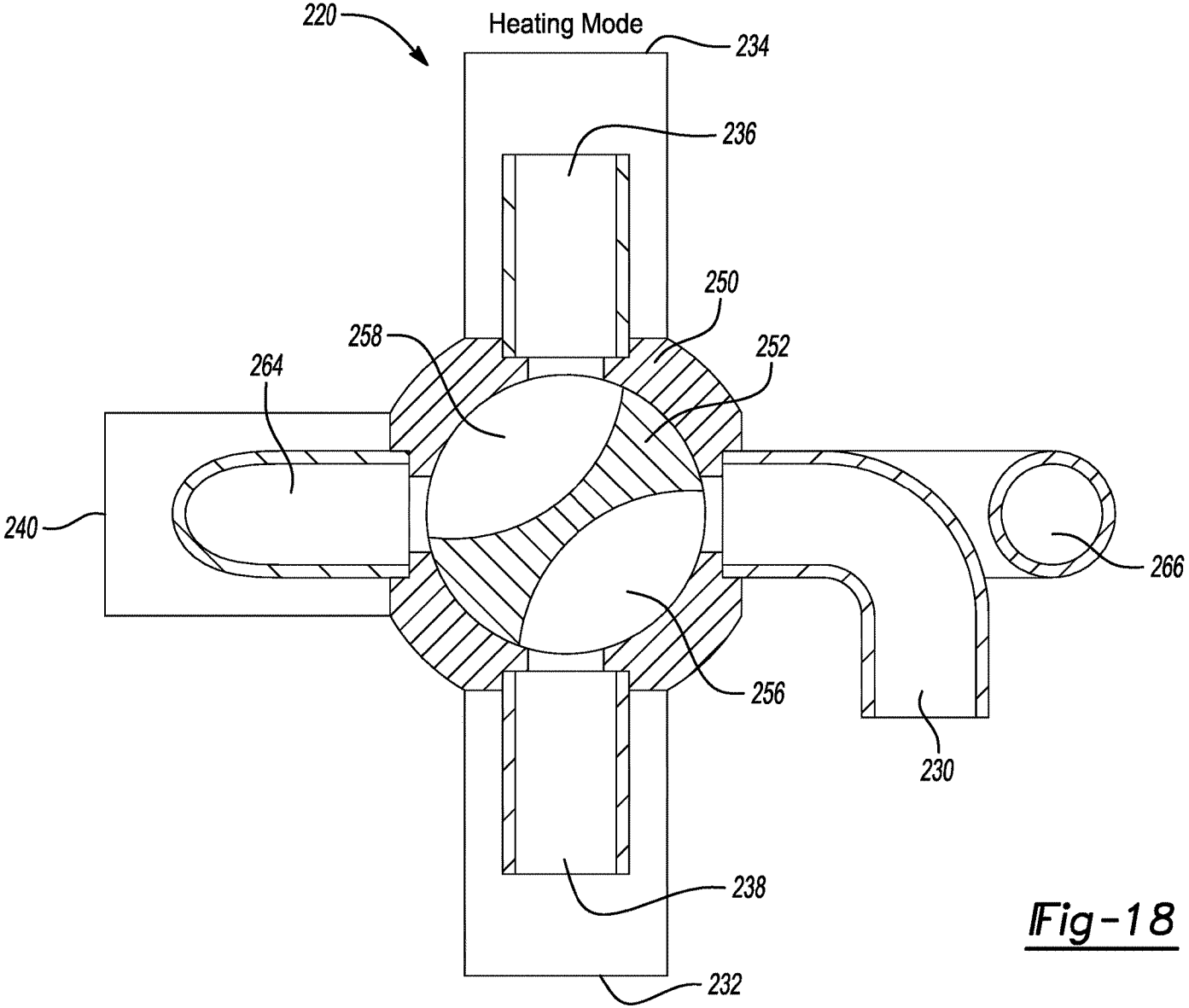
FIG. 18 is another cross-sectional view of the multiway valve in the second position corresponding to the heating mode.
Figure 19:
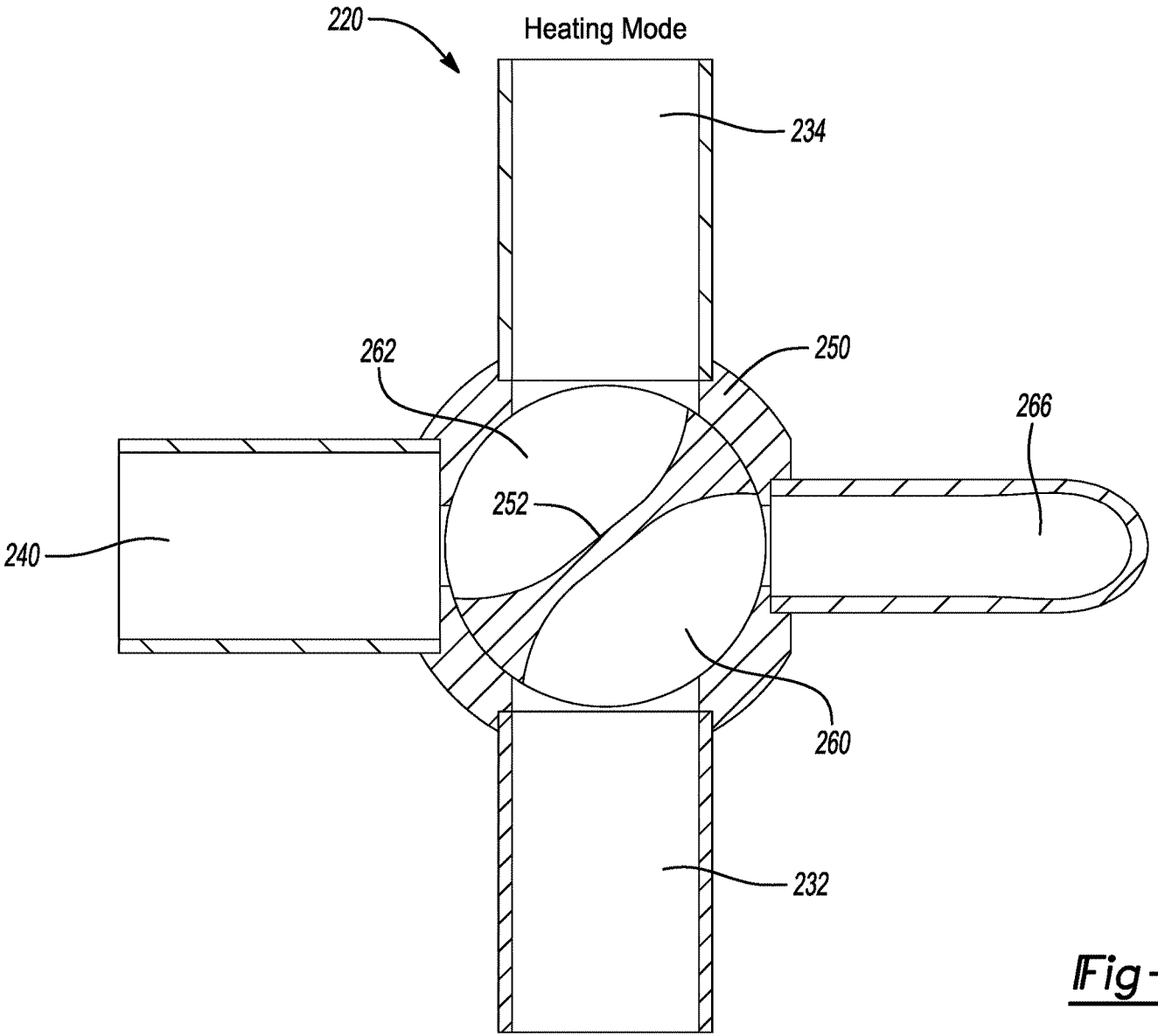
FIG. 19 is another cross-sectional view of the multiway valve in the second position corresponding to the heating mode.
Figure 20:
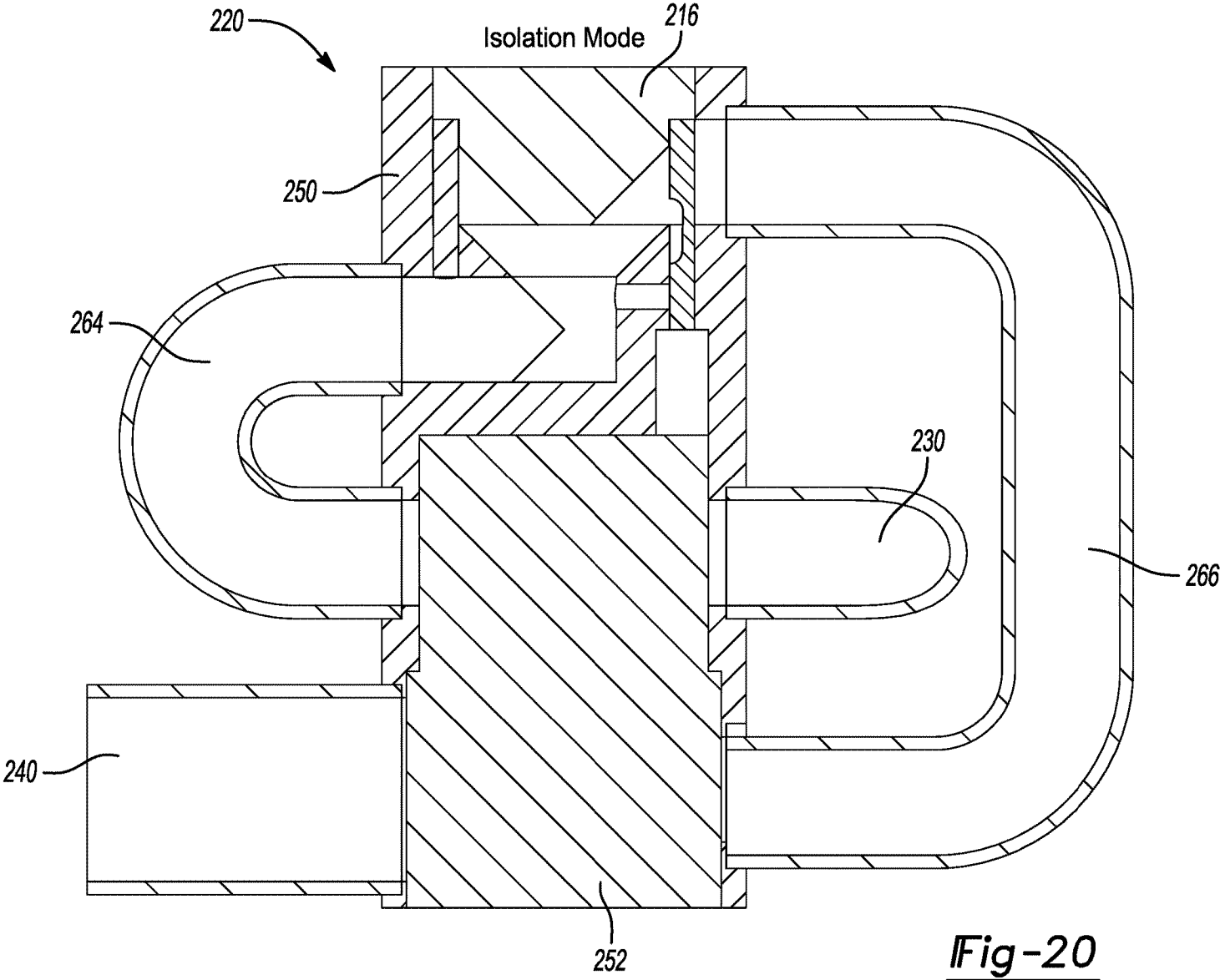
FIG. 20 is a cross-sectional view of the multiway valve in a third position corresponding to the isolation mode.
Figure 21:
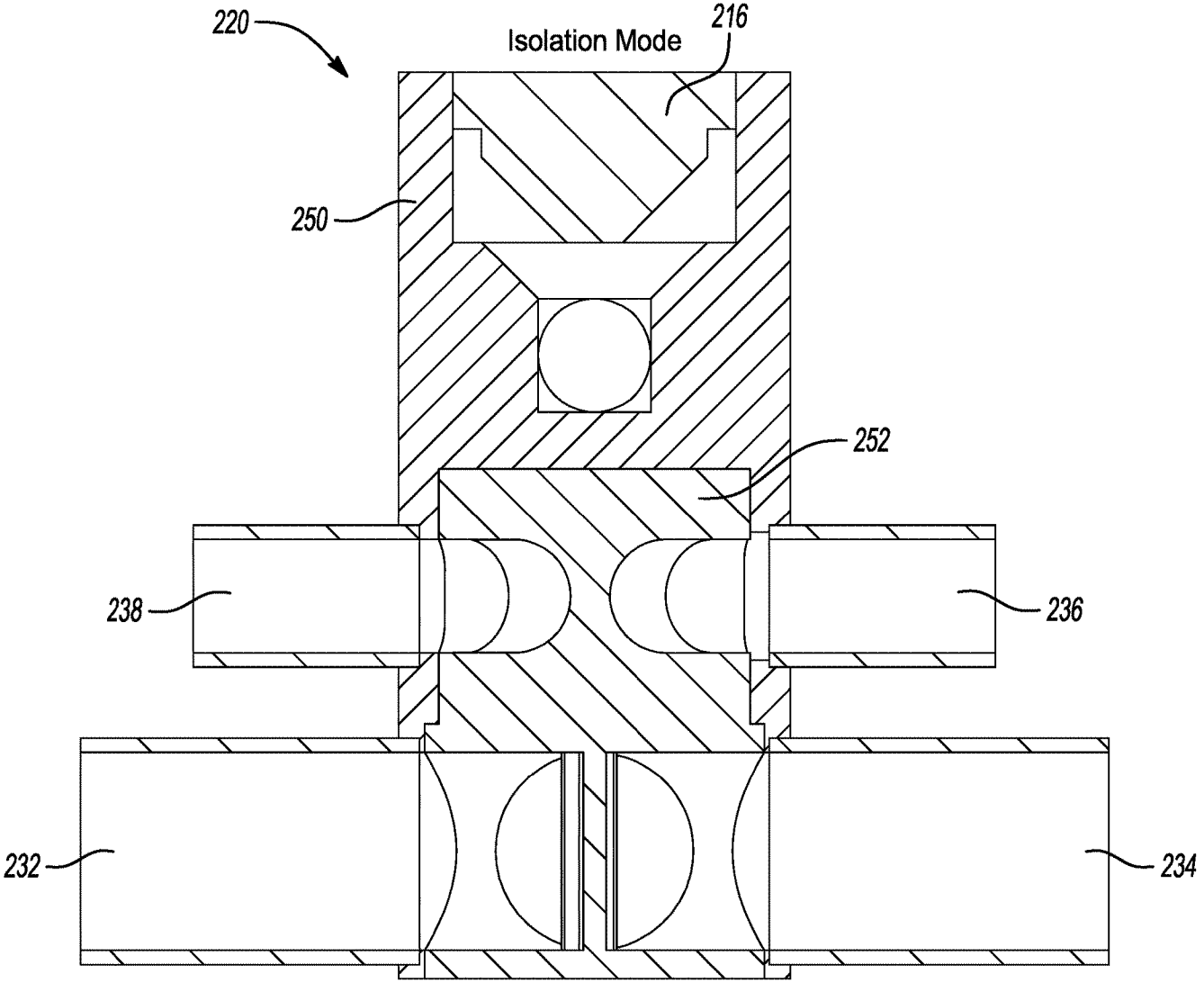
FIG. 21 is another cross-sectional view of the multiway valve in the third position corresponding to the isolation mode.
Figure 22:
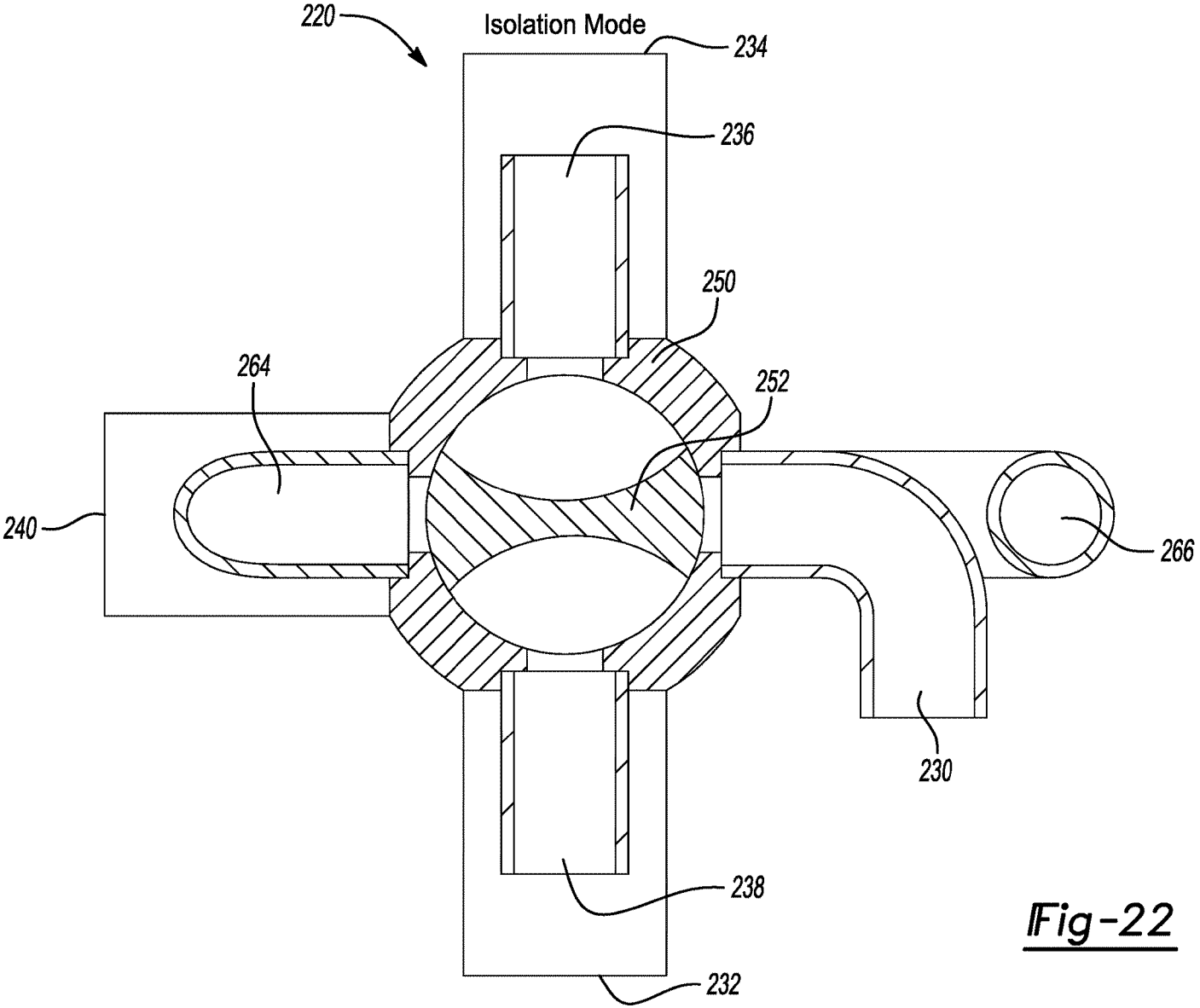
FIG. 22 is another cross-sectional view of the multiway valve in the third position corresponding to the isolation mode.
Figure 23:
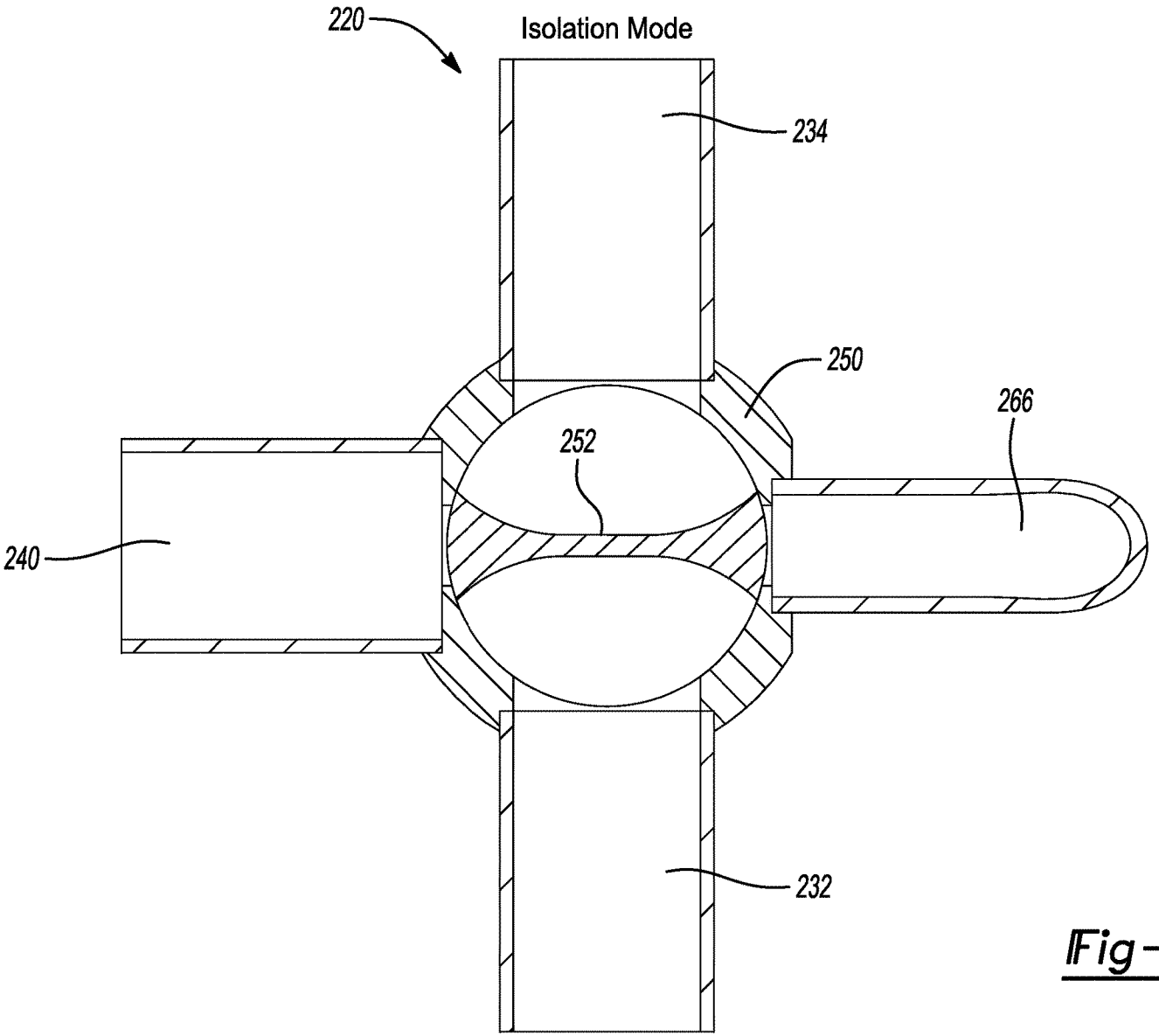
FIG. 23 is another cross-sectional view of the multiway valve in the third position corresponding to the isolation mode.

As shown in FIG. 11, the valve member 252 may be a generally cylindrical body having a first passageway 256, a second passageway 258, a third passageway 260, and a fourth passageway 262. The first and second passageways 256, 258 may be disposed radially opposite each other, and the third and fourth passageways 260, 262 may be disposed radially opposite each other and axially spaced apart from the first and second passageways 256, 258.

When the system 210 is in the cooling mode, the valve member 252 is in the first position (FIGS. 12-15). Therefore, when the system 210 is in the cooling mode: (a) the first passageway 256 fluidly connects the first inlet 230 with the first outlet 236 (shown in FIGS. 6 and 14), (b) the second passageway 258 fluidly connects the expansion device 216 with the second outlet 238 (shown in FIGS. 6 and 14) (e.g., an outlet of the expansion device 216 may provide working fluid to the second passageway 258 via a first conduit 264), (c) the third passageway 260 fluidly connects the third inlet 234 with the expansion device 216 (shown in FIGS. 6 and 15) (e.g., an inlet of the expansion device 216 may receive working fluid from the third passageway 260 via a second conduit 266), and (d) the fourth passageway 262 fluidly connects the second inlet 232 with the third outlet 240 (shown in FIGS. 6 and 15).

Therefore, in the cooling mode (as shown in FIG. 6), compressed working fluid is discharged from the compressor 212 through the discharge outlet 228 of the compressor 212. From the discharge outlet 228, the working fluid flows into the first inlet 230 of the valve 220. The working fluid then flows from the first inlet 230, through the first passageway 256 of the valve member 252 and out of the valve 220 through the first outlet 236. From the first outlet 236, the working fluid flows into the inlet 233 of the outdoor heat exchanger 214, through the outdoor heat exchanger 214, and out of the outdoor heat exchanger 214 though the outlet 231. From the outlet 231 of the outdoor heat exchanger 214, the working fluid flows into the third inlet 234 of the valve 220. From the third inlet 234, the working fluid flows through the third passageway 260 of the valve member 252, through the second conduit 266 and into the inlet of the expansion device 216. The working fluid then flows from the outlet of the expansion device 216 through the first conduit 264, through the second passageway 258 of the valve member 252 and through the second outlet 238 of the valve 220. From the second outlet 238, the working fluid flows into the inlet 235 of the indoor heat exchanger 218, through the indoor heat exchanger 218, and out of the indoor heat exchanger 218 though the outlet 229. From the outlet 229 of the indoor heat exchanger 218, the working fluid flows into the second inlet 232 of the valve 220, through the fourth passageway 262 of the valve member 252, and through the third outlet 240 of the valve 220. From the third outlet 240, the working fluid flows back to the inlet 237 of the compressor 212.

When the system 210 is in the heating mode, the valve member 252 is in the second position (FIGS. 16-19). Therefore, when the system 210 is in the heating mode: (a) the first passageway 256 fluidly connects the first inlet 230 with the second outlet 238 (shown in FIGS. 7 and 18), (b) the second passageway 258 fluidly connects the expansion device 216 with the first outlet 236 (shown in FIGS. 7 and 18) (e.g., the outlet of the expansion device 216 may provide working fluid to the second passageway 258 via the first conduit 264), (c) the third passageway 260 fluidly connects the second inlet 232 with the expansion device 216 (shown in FIGS. 7 and 19) (e.g., the inlet of the expansion device 216 may receive working fluid from the third passageway 260 via the second conduit 266), and (d) the fourth passageway 262 fluidly connects the third inlet 234 with the third outlet 240 (shown in FIGS. 7 and 19).

Therefore, in the heating mode (as shown in FIG. 7), compressed working fluid is discharged from the compressor 212 through the discharge outlet 228 of the compressor 212. From the discharge outlet 228, the working fluid flows into the first inlet 230 of the valve 220. The working fluid then flows from the first inlet 230, through the first passageway 256 of the valve member 252 and out of the valve 220 through the second outlet 238. From the second outlet 238, the working fluid flows into the inlet 235 of the indoor heat exchanger 218, through the indoor heat exchanger 218, and out of the indoor heat exchanger 218 though the outlet 229. From the outlet 229 of the indoor heat exchanger 218, the working fluid flows into the second inlet 232 of the valve 220. From the second inlet 232, the working fluid flows through the third passageway 260 of the valve member 252, through the second conduit 266 and into the inlet of the expansion device 216. The working fluid then flows from the outlet of the expansion device 216 through the first conduit 264, through the second passageway 258 of the valve member 252 and through the first outlet 236 of the valve 220. From the first outlet 236, the working fluid flows into the inlet 233 of the outdoor heat exchanger 214, through the outdoor heat exchanger 214, and out of the outdoor heat exchanger 214 though the outlet 231. From the outlet 231 of the outdoor heat exchanger 214, the working fluid flows into the third inlet 234 of the valve 220, through the fourth passageway 262 of the valve member 252, and through the third outlet 240 of the valve 220. From the third outlet 240, the working fluid flows back to the inlet 237 of the compressor 212.

When the system 210 is in the isolation mode, the valve member 252 is in the third position (FIGS. 20-23). Therefore, when the system 210 is in the isolation mode, the valve member 252 is positioned to prevent fluid flow through any of the first, second, third, and fourth passageways 256, 258, 260, 262. Therefore, in the isolation mode, the compressor 212, outdoor heat exchanger 214, expansion device 216, and indoor heat exchanger 218 are all fluidly isolated from each other. By preventing fluid communication among the compressor 212, outdoor heat exchanger 214, expansion device 216, and indoor heat exchanger 218 in the isolation mode, the valve 220 limits the amount of working fluid that could possibly leak into the building when the compressor 212 is non-operational.

With reference to FIGS. 24 and 25, another heat-pump system 310 is provided. The system 310 may include a compressor 312, an outdoor heat exchanger 314, an expansion device 316, an indoor heat exchanger 318, and a multiway valve (reversing valve) 320. Like the system 10, the system 310 may be operable in a cooling mode and in a heating mode. As in the system 10, working fluid circulating through the system 310 may flow through the outdoor heat exchanger 314 in the same direction in the heating and cooling modes, and the working fluid may flow through the indoor heat exchanger 318 in the same direction in the heating and cooling modes. Furthermore, working fluid may flow through the expansion device 316 in the same direction in the heating and cooling modes.

The structure and function of the compressor 312, outdoor heat exchanger 314, expansion device 316, and indoor heat exchanger 318 may be similar or identical to that of the compressor 12, outdoor heat exchanger 14, expansion device 16, and indoor heat exchanger 18 described above.

As shown in FIGS. 26-32, the valve 320 may include a valve body 352 and a valve member 354. The valve body 352 includes an internal cavity 353 (e.g., a cylindrical cavity) in which the valve member 354 is movably disposed. The valve body 352 includes a first upper port 355, a second upper port 356, a third upper port 357, a fourth upper port 358, a fifth upper port 359, a sixth upper port 360, a first lower port 361, a second lower port 362, a third lower port 363, a fourth lower port 364, a fifth lower port 365, and a sixth lower port 366. The ports 355-366 extend into the cavity 353.

The sixth upper port 360 defines a first inlet 330 (FIGS. 28 and 31) that is in fluid communication with a discharge outlet 328 of the compressor 312 such that the first inlet 330 receives working fluid from the compressor 312 in the heating mode and in the cooling mode. The fourth lower port 364 defines a second inlet 332 (FIGS. 29 and 32) that is in fluid communication with an outlet 329 of the indoor heat exchanger 318 such that the second inlet 332 receives working fluid from the indoor heat exchanger 318 in the heating mode and in the cooling mode. The second lower port 362 defines a third inlet 334 (FIGS. 29 and 32) that is in fluid communication with an outlet 331 of the outdoor heat exchanger 314 such that the third inlet 334 receives working fluid from the outdoor heat exchanger 314 in the heating mode and in the cooling mode. The sixth lower port 366 defines a fourth inlet 335 (FIGS. 29 and 32) that is in fluid communication with an outlet 337 of the expansion device 316 such that the fourth inlet 335 receives working fluid from the expansion device 316 in the heating mode and in the cooling mode. The first lower port 361 defines a first outlet 336 (FIGS. 29 and 32) that is in fluid communication with an inlet 333 of the outdoor heat exchanger 314 such that the outdoor heat exchanger 314 receives working fluid from the first outlet 336 in the heating mode and in the cooling mode. The fifth lower port 365 defines a second outlet 338 that is in fluid communication with an inlet 327 of the indoor heat exchanger 318 such that the indoor heat exchanger 318 receives working fluid from the second outlet 338 in the heating mode and in the cooling mode. The third upper port 357 defines a third outlet 340 (FIGS. 28 and 31) that is in fluid communication with a suction inlet 326 of the compressor 312 such that the compressor 312 receives working fluid from the third outlet 340 in the heating mode and in the cooling mode. The third lower port 363 defines a fourth outlet 341 (FIGS. 29 and 32) that is in fluid communication with an inlet 339 of the expansion device 316 such that the expansion device 316 receives working fluid from the fourth outlet 341 in the heating mode and in the cooling mode.

As shown in FIGS. 28 and 31, external openings of the first, second, fourth, and fifth upper ports 355, 356, 358, 359 may be sealed with plugs 321. The first, second, fourth, and fifth upper ports 355, 356, 358, 359 may include apertures 323. The aperture 323 of the first upper port 355 interconnects the first upper port 355 with the first lower port 361. In this manner, the first upper port 355 and the first lower port 361 are in fluid communication with each other and with the inlet 333 of the outdoor heat exchanger 314. The aperture 323 of the second upper port 356 interconnects the second upper port 356 with the second lower port 362. In this manner, the second upper port 356 and the second lower port 362 are in fluid communication with each other and with the outlet 331 of the outdoor heat exchanger 314. The aperture 323 of the fourth upper port 358 interconnects the fourth upper port 358 with the fourth lower port 364. In this manner, the fourth upper port 358 and the fourth lower port 364 are in fluid communication with each other and with the outlet 329 of the indoor heat exchanger 318. The aperture 323 of the fifth upper port 359 interconnects the fifth upper port 359 with the fifth lower port 365. In this manner, the fifth upper port 359 and the fifth lower port 365 are in fluid communication with each other and with the inlet 327 of the indoor heat exchanger 318.

The valve member 354 is movable (e.g., slidable) relative to the valve body 352 among a first position (FIGS. 27-29) corresponding to the cooling mode and a second position (FIGS. 30-32) corresponding to the heating mode. The valve member 252 may be actuated by fluid pressure, an electric motor, a solenoid, or any other actuator.

The valve member 354 may be a generally cylindrical body having a first upper passageway 370 (FIG. 28), a second upper passageway 372 (FIG. 28), a first intermediate passageway 374 (FIGS. 29 and 31), and a second intermediate passageway 376 (FIGS. 29 and 31), a first lower passageway 378 (FIG. 32), and a second lower passageway 380 (FIG. 32). The upper passageways 370, 372 are disposed axially offset from the intermediate passageways 374, 376 and the lower passageways 378, 380. The intermediate passageways 374, 376 are disposed axially between the upper passageways 370, 372 and the lower passageways 378, 380.

When the system 310 is in the cooling mode (FIGS. 24 and 27-29), the valve member 354 is in the first position. Therefore, when the system 310 is in the cooling mode: (a) the first upper passageway 370 fluidly connects the first inlet 330 with the first outlet 336 (via aperture 323 of the first upper port 355) (FIG. 28), (b) the second upper passageway 372 fluidly connects the second inlet 332 with the third outlet 340 (via aperture 323 of the fourth upper port 358) (FIG. 28), (c) the first intermediate passageway 374 fluidly connects the fourth inlet 335 with the second outlet 338 (FIG. 29), and (d) the second intermediate passageway 376 fluidly connects the third inlet 334 with the fourth outlet 341 (FIG. 29). In the cooling mode, the first and second lower passageways 378, 380 are not in fluid communication with any of the ports 355-366 (i.e., the first and second lower passageways 378, 380 are not in fluid communication with any of the inlets 330, 332, 334, 335 or outlets 336, 338, 340, 341).

Therefore, in the cooling mode (as shown in FIG. 24), compressed working fluid is discharged from the compressor 312 through the discharge outlet 328 of the compressor 312. From the discharge outlet 328, the working fluid flows into the first inlet 330 of the valve 320. The working fluid then flows from the first inlet 330, through the first upper passageway 370 of the valve member 354 and out of the valve 320 through the first outlet 336. From the first outlet 336, the working fluid flows into the inlet 333 of the outdoor heat exchanger 314, through the outdoor heat exchanger 314, and out of the outdoor heat exchanger 314 though the outlet 331. From the outlet 331 of the outdoor heat exchanger 314, the working fluid flows into the third inlet 334 of the valve 320. From the third inlet 334, the working fluid flows through the second intermediate passageway 376 of the valve member 354, through the fourth outlet 341 of the valve 320, and into the inlet 339 of the expansion device 316. The working fluid then flows from the outlet 337 of the expansion device 316 through the fourth inlet 335 of the valve 320, through the first intermediate passageway 374 of the valve member 354, and through the second outlet 338 of the valve 320. From the second outlet 338, the working fluid flows into the inlet 327 of the indoor heat exchanger 318, through the indoor heat exchanger 318, and out of the indoor heat exchanger 318 though the outlet 329. From the outlet 329 of the indoor heat exchanger 318, the working fluid flows into the second inlet 332 of the valve 320, through the second upper passageway 372 of the valve member 354, and through the third outlet 340 of the valve 320. From the third outlet 340, the working fluid flows back to the inlet 326 of the compressor 312.

When the system 310 is in the heating mode (FIGS. 25 and 30-32, the valve member 354 is in the second position. Therefore, when the system 310 is in the heating mode: (a) the first intermediate passageway 374 fluidly connects the first inlet 330 with the second outlet 338 (via aperture 323 in the fifth upper port 359), (b) the second intermediate passageway 376 fluidly connects the third inlet 334 with the third outlet 340 (via aperture 323 in the second upper port 356), (c) the first lower passageway 378 fluidly connects the fourth inlet 335 with the first outlet 336, and (d) the second lower passageway 380 fluidly connects the second inlet 332 with the fourth outlet 341. In the heating mode, the first and second upper passageways 370, 372 are not in fluid communication with any of the ports 355-366 (i.e., the first and second upper passageways 370, 372 are not in fluid communication with any of the inlets 330, 332, 334, 335 or outlets 336, 338, 340, 341).

Therefore, in the heating mode (as shown in FIG. 25), compressed working fluid is discharged from the compressor 312 through the discharge outlet 328 of the compressor 312. From the discharge outlet 328, the working fluid flows into the first inlet 330 of the valve 320. The working fluid then flows from the first inlet 330, through the first intermediate passageway 374 of the valve member 354 and out of the valve 320 through the second outlet 338. From the second outlet 338, the working fluid flows into the inlet 327 of the indoor heat exchanger 318, through the indoor heat exchanger 318, and out of the indoor heat exchanger 318 though the outlet 329. From the outlet 329 of the indoor heat exchanger 318, the working fluid flows into the second inlet 332 of the valve 320. From the second inlet 332, the working fluid flows through the second lower passageway 380 of the valve member 354, through the fourth outlet 341 of the valve 320 and into the inlet of the expansion device 316. The working fluid then flows from the outlet 337 of the expansion device 316 through the fourth inlet 335 of the valve 320, through the first lower passageway 378 of the valve member 354 and through the first outlet 336 of the valve 320. From the first outlet 336, the working fluid flows into the inlet 333 of the outdoor heat exchanger 314, through the outdoor heat exchanger 314, and out of the outdoor heat exchanger 314 though the outlet 331. From the outlet 331 of the outdoor heat exchanger 314, the working fluid flows into the third inlet 334 of the valve 320, through the aperture 323 of second upper port 356, through the second intermediate passageway 376 of the valve member 354, and through the third outlet 340 of the valve 320. From the third outlet 340, the working fluid flows back to the inlet 326 of the compressor 312.

In this application, including the definitions below, the term "module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit;

other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat-pump system comprising:

an outdoor heat exchanger;

an expansion device in fluid communication with the outdoor heat exchanger;

an indoor heat exchanger in fluid communication with the expansion device;

a compressor circulating working fluid through the indoor and outdoor heat exchangers; and a multiway valve movable between a first position corresponding to a cooling mode of the heat-pump system, a second position corresponding to a heating mode of the heat-pump system, and a third position corresponding to an isolation mode of the heat-pump system, wherein working fluid flows in the same direction through the outdoor heat exchanger in the cooling mode and in the heating mode, and wherein working fluid flows in the same direction through the indoor heat exchanger in the cooling mode and in the heating mode, and wherein when the heat-pump system is in the isolation mode: (i) the multiway valve fluidly isolates the indoor heat exchanger from the compressor and the outdoor heat exchanger, (ii) the multiway valve fluidly isolates the outdoor heat exchanger from the compressor, and (iii) the compressor is off.

2. The heat-pump system of claim 1, wherein the multiway valve includes a first inlet, a second inlet, a first outlet, and a second outlet.

3. The heat-pump system of claim 2, wherein the first inlet receives working fluid from the compressor in the heating mode and in the cooling mode.

4. The heat-pump system of claim 3, wherein the outdoor heat exchanger receives working fluid from the first outlet in the heating mode and in the cooling mode.

5. The heat-pump system of claim 4, wherein the indoor heat exchanger receives working fluid from the second outlet in the heating mode and in the cooling mode.

6. The heat-pump system of claim 2, wherein the multiway valve includes a third inlet and a third outlet, and wherein:

the first inlet of the multiway valve receives working fluid from the compressor in the heating mode and in the cooling mode, the second inlet of the multiway valve receives working fluid from the indoor heat exchanger in the heating mode and in the cooling mode, the third inlet of the multiway valve receives working fluid from the outdoor heat exchanger in the heating mode and in the cooling mode, the outdoor heat exchanger receives working fluid from the first outlet of the multiway valve in the heating mode and in the cooling mode, the indoor heat exchanger receives working fluid from the second outlet of the multiway valve in the heating mode and in the cooling mode, and the compressor receives working fluid from the third outlet of the multiway valve in the heating mode and in the cooling mode.

7. The heat-pump system of claim 6, wherein the first, second, and third inlets and the first, second, and third outlets are formed in a valve body of the multiway valve, wherein the multiway valve includes a valve member disposed within the valve body, wherein the valve member is movable relative to the valve body between the first position and the second position.

8. The heat-pump system of claim 7, wherein the valve member at least partially defines a first passageway, a second passageway, a third passageway, and a fourth passageway.

9. The heat-pump system of claim 8, wherein in the cooling mode:

the first passageway fluidly connects the first inlet and the first outlet and extends from the first inlet to the first outlet, the second passageway allows fluid flow from the expansion device to the second outlet, the third passageway allows fluid flow from the third inlet to the expansion device, and the fourth passageway fluidly connects the second inlet and the third outlet and extends from the second inlet to the third outlet.

10. The heat-pump system of claim 9, wherein the valve member is rotatable relative to the valve body between the first and second positions.

11. The heat-pump system of claim 8, wherein the multiway valve includes a fourth inlet and a fourth outlet, wherein the fourth inlet is fluidly connected to an outlet of the expansion device, and wherein the fourth outlet is fluidly connected to an inlet of the expansion device.

12. The heat-pump system of claim 11, wherein the valve member includes a fifth and sixth passageway.

13. The heat-pump system of claim 12, wherein the fifth and sixth passageways of the valve member are fluidly isolated from the first, second, third, and fourth inlets and the first, second, third, and fourth outlets in the cooling mode, and wherein the first and second passageways of the valve member are fluidly isolated from the first, second, third, and fourth inlets and the first, second, third, and fourth outlets in the heating mode.

14. The heat-pump system of claim 13, wherein the valve member is slidable in an axial direction relative to the valve body between the first and second positions.

15. The heat-pump system of claim 6, wherein the expansion device is disposed within a valve body of the multiway valve.

16. The heat-pump system of claim 1, wherein when the heat-pump system is in the isolation mode, the multiway valve fluidly isolates the expansion device from the indoor heat exchanger and the outdoor heat exchanger.

* * * * *